US011529807B2

(12) United States Patent
Orii et al.

(10) Patent No.: US 11,529,807 B2
(45) Date of Patent: Dec. 20, 2022

(54) PRINT HEAD DRIVE CIRCUIT AND PRINTING APPARATUS

(71) Applicant: SEIKO EPSON CORPORATION, Tokyo (JP)

(72) Inventors: Hiromitsu Orii, Nagano (JP); Toru Matsuyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/209,407

(22) Filed: Mar. 23, 2021

(65) Prior Publication Data

US 2021/0300028 A1 Sep. 30, 2021

(30) Foreign Application Priority Data

Mar. 25, 2020 (JP) ..... JP2020-054538

(51) Int. Cl.
*B41J 2/045* (2006.01)

(52) U.S. Cl.
CPC ..... *B41J 2/04541* (2013.01); *B41J 2/04573* (2013.01); *B41J 2/04581* (2013.01)

(58) Field of Classification Search
CPC ..... B41J 2/04581
See application file for complete search history.

(56) References Cited

U.S. PATENT DOCUMENTS

2001/0038404 A1 11/2001 Kitahara et al.
2002/0012017 A1* 1/2002 Yonekubo ..... B41J 2/04563 347/10
2002/0080218 A1* 6/2002 Kaga ..... B41J 29/393 347/104
2002/0158926 A1* 10/2002 Fukano ..... B41J 2/04596 347/15
2003/0025744 A1* 2/2003 Nou ..... B41J 2/04595 347/12
2008/0129770 A1* 6/2008 Mizugaki ..... B41J 2/04588 347/10
2017/0151776 A1 6/2017 Chikamoto
2018/0170079 A1 6/2018 Koike et al.
2020/0091041 A1* 3/2020 Matsumoto ..... B41J 2/04563

FOREIGN PATENT DOCUMENTS

CN 108215487 A 6/2018
EP 3 340 595 A1 6/2018
JP 2001-328267 A 11/2001
JP 2003-001824 A 1/2003

* cited by examiner

*Primary Examiner* — Shelby L Fidler
(74) *Attorney, Agent, or Firm* — Global IP Counselors, LLP

(57) ABSTRACT

A print head drive circuit that drives a print head including an ejection portion having a piezoelectric element and a changeover switch, with a selection signal including a first information block and a second information block for selecting whether or not to drive the piezoelectric element, and a switching timing signal for changing a logic level to control a switching timing of the changeover switch, outputs the first information block in which a logic level of the selection signal changes without changing a logic level of the switching timing signal in a first period, changes the logic level of the switching timing signal, and does not change the logic level of the selection signal in a second period, and outputs the second information block in which the logic level of the selection signal changes without changing the logic level of the switching timing signal in a third period.

7 Claims, 13 Drawing Sheets

| [LATa, LATb] ([SIH, SIL]) | | [1, 1] | [1, 0] | [0, 1] | [0, 0] |
|---|---|---|---|---|---|
| SIZE OF DOTS | | LARGE DOT | MEDIUM DOT | SMALL DOT | NON-RECORDING |
| SELECTION CONTROL SIGNAL (PROGRAM DATA) | | Q0 (q0) | Q1 (q1) | Q2 (q2) | Q3 (q3) |
| S | Ta | H | H | L | L |
| | Tb | H | L | H | L |
| | Tc | L | L | L | H |

PRINT HEAD DRIVE CIRCUIT AND PRINTING APPARATUS

The present application is based on, and claims priority from JP Application Serial Number 2020-054538, filed Mar. 25, 2020, the disclosure of which is hereby incorporated by reference herein in its entirety.

BACKGROUND

1. Technical Field

The present disclosure relates to a print head drive circuit for controlling a stable drive of a print head provided with multiple piezoelectric elements, and a printing apparatus.

2. Related Art

As a printing apparatus such as an ink jet printer, there is known a so-called piezoelectric printing apparatus that forms characters and images on a medium by driving a drive element including a piezoelectric element provided in a print head by a drive signal and ejecting a liquid such as an ink filled in a cavity from a nozzle by driving the drive element.

In addition, as such a piezoelectric printing apparatus, there is known a printing method provided with a unimorph type drive element capable of forming a high-density ejection portion by sandwiching the piezoelectric element between two electrodes, and a printing method capable of increasing the drive amount of the drive element as compared with the printing method including the unimorph type drive element by providing a laminated drive element formed by stacking a piezoelectric element and an electrode in multiple layers as illustrated in JP-A-2001-328267, and capable of increasing the amount of liquid ejected per unit drive of a drive element.

In addition, in JP-A-2003-001824, a piezoelectric printing apparatus capable of producing a multi-gradation printed matter by arranging drive elements including a piezoelectric element at a high density, and a format of a data signal including information for producing a printed matter used in the printing apparatus are disclosed.

In recent years, there is an increasing market demand for increasing productivity in the piezoelectric printing apparatus as described in JP-A-2001-328267 and JP-A-2003-001824. In response to such market demands, in the piezoelectric printing apparatus, it is required to increase the number of nozzles included in the print head and the number of drive elements including the piezoelectric element for driving the nozzles, and to increase the amount of liquid ejected per unit drive of the drive elements.

In order to increase the amount of liquid ejected per unit drive of the drive element including the piezoelectric element, it is necessary to drive the drive element to a large extent, and therefore it is necessary to supply a larger amount of current to the drive element. However, when a large amount of current is supplied to the drive element including the piezoelectric element, the influence of noise generated by the current increases. When the noise is superimposed on the data signal including the information for producing the printed matter, there is a possibility that malfunction of the printing apparatus may be generated.

In particular, when one print head includes 1500 or more nozzles and a piezoelectric element, the amount of current supplied to the print head increases, the amount of information included in the data signal for producing printed matter also increases, and there is a significant possibility that malfunction of the printing apparatus may be generated.

SUMMARY

According to an aspect of the present disclosure, there is provided a print head drive circuit that drives a print head including 1500 or more ejection modules each having an ejection portion having a piezoelectric element driven by supplying a drive signal and ejecting a liquid on a medium as the piezoelectric element is driven, and a changeover switch switching whether or not to supply the drive signal to the piezoelectric element, with a selection signal including a first information block and a second information block for selecting whether or not to drive the piezoelectric element, and a switching timing signal for changing a logic level to control a switching timing of the changeover switch, in which the print head drive circuit outputs the first information block in which a logic level of the selection signal changes without changing a logic level of the switching timing signal in a first period, changes the logic level of the switching timing signal, and does not change the logic level of the selection signal in a second period after the first period, and outputs the second information block in which the logic level of the selection signal changes without changing the logic level of the switching timing signal in a third period after the second period.

According to another aspect of the present disclosure, there is provided a printing apparatus including a print head including 1500 or more ejection modules each having an ejection portion having a piezoelectric element driven by supplying a drive signal and ejecting a liquid on a medium as the piezoelectric element is driven, and a changeover switch switching whether or not to supply the drive signal to the piezoelectric element; and a print head drive circuit that outputs a selection signal including a first information block and a second information block for selecting whether or not to drive the piezoelectric element driving the print head, and a switching timing signal for changing a logic level to control a switching timing of the changeover switch, in which the print head drive circuit outputs the first information block in which a logic level of the selection signal changes without changing a logic level of the switching timing signal in a first period, changes the logic level of the switching timing signal, and does not change the logic level of the selection signal in a second period after the first period, and outputs the second information block in which the logic level of the selection signal changes without changing the logic level of the switching timing signal in a third period after the second period.

DESCRIPTION OF EXEMPLARY EMBODIMENTS

Hereinafter, preferred embodiments of the present disclosure will be described with reference to the drawings. The drawings used are for convenience of description. The embodiments described below do not unreasonably limit the contents of the present disclosure described in the aspects. In addition, not all of the configurations described below are essential constituent requirements of the present disclosure.

1. Overview of Printing Apparatus

Figure 1:
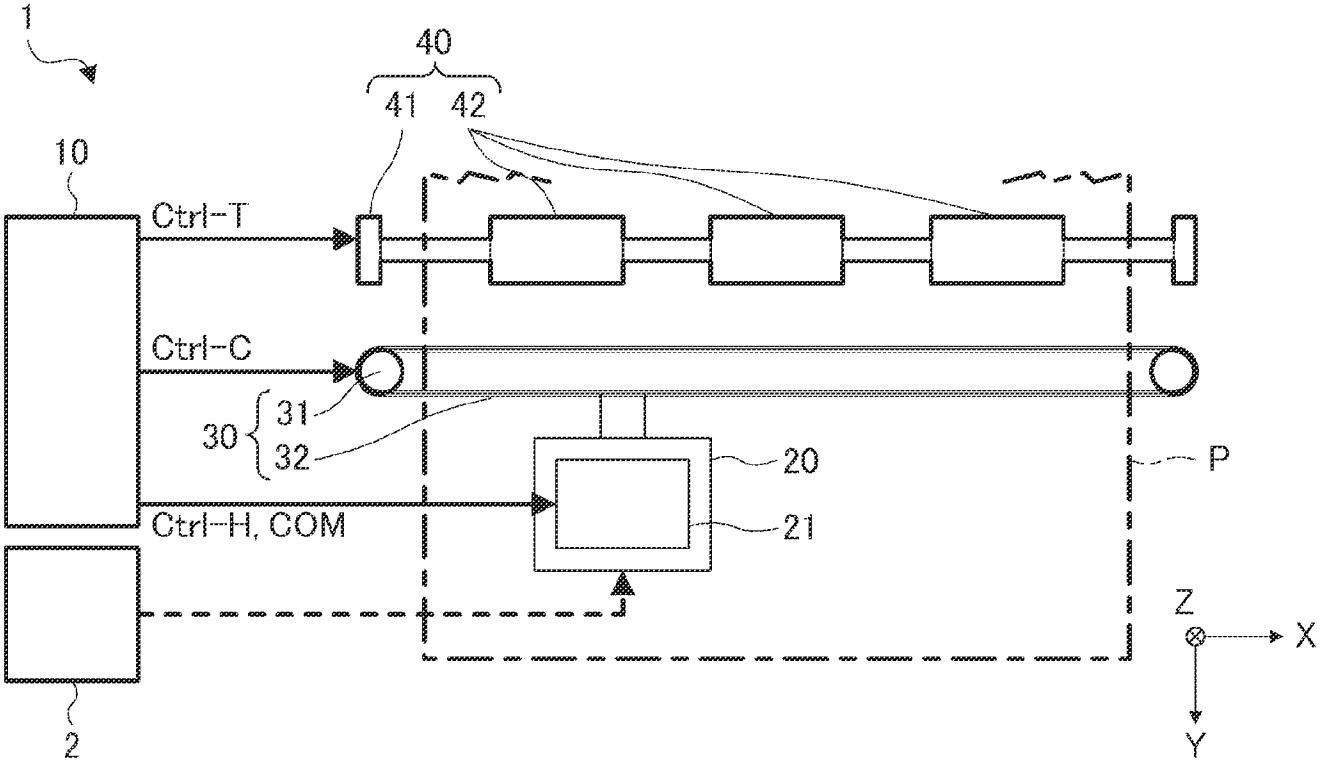
FIG. 1 is a diagram illustrating a schematic configuration of a printing apparatus.

FIG. 1 is a diagram illustrating a schematic configuration of a printing apparatus 1. The printing apparatus 1 of the present embodiment is described by exemplifying a serial printing type ink jet printer that forms an image on a medium P by reciprocating a carriage 20 on which a print head 21 that ejects an ink as an example of a liquid is mounted and ejecting the ink onto a transported medium P. In the following description, a direction where the carriage 20 moves is described as an X direction, a direction where the medium P is transported is described as a Y direction, and a direction where the ink is ejected is described as a Z direction. Although the X direction, the Y direction, and the Z direction are described as being orthogonal to each other, the present disclosure is not limited to the various configurations constituting the printing apparatus 1 being provided orthogonally to each other. In addition, as the medium P, any printing target such as printing paper, resin film, or cloth can be used. In addition, the printing apparatus 1 may be a so-called line printing type ink jet printer that forms an image on a medium by ejecting the ink to a medium transported from the print head provided side by side above a width of the medium.

As illustrated in FIG. 1, the printing apparatus 1 is provided with an ink container 2, a control mechanism 10, a carriage 20, a movement mechanism 30, and a transport mechanism 40.

A plurality of types of ink to be ejected on the medium P are stored in the ink container 2. Examples of the color of the ink stored in the ink container 2 include black, cyan, magenta, yellow, red, and gray. As the ink container 2 in which such ink is stored, an ink cartridge, a bag-shaped ink pack made of a flexible film, an ink tank capable of replenishing ink, and the like can be used.

The control mechanism 10 includes, for example, a processing circuit such as a central processing unit (CPU) or a field programmable gate array (FPGA), and a storage circuit such as a semiconductor memory, and controls each element of the printing apparatus 1.

The print head 21 is mounted on the carriage 20. In addition, the carriage 20 is fixed to an endless belt 32 included in the movement mechanism 30. The ink container 2 may be mounted on the carriage 20.

A control signal Ctrl-H for controlling the print head 21 output by the control mechanism 10 and one or a plurality of drive signals COM for driving the print head 21 are input to the print head 21. The print head 21 ejects the ink supplied from the ink container 2 based on the control signal Ctrl-H and the drive signal COM.

The movement mechanism 30 includes a carriage motor 31 and an endless belt 32. The carriage motor 31 operates based on a control signal Ctrl-C input from the control mechanism 10. The endless belt 32 rotates according to the operation of the carriage motor 31. As a result, the carriage 20 fixed to the endless belt 32 reciprocates in the X direction.

The transport mechanism 40 includes a transport motor 41 and a transport roller 42. The transport motor 41 operates based on a control signal Ctrl-T input from the control mechanism 10. The transport roller 42 rotates according to the operation of the transport motor 41. The medium P is transported in the Y direction as the transport roller 42 rotates.

As described above, the printing apparatus 1 ejects the ink from the print head 21 mounted on the carriage 20 in conjunction with the transport of the medium P by the transport mechanism 40 and the reciprocating movement of the carriage 20 by the movement mechanism 30 to land the ink at any position on the surface of the medium P and to form a desired image on the medium P.

2. Electrical Configuration of Printing Apparatus

Figure 2A:
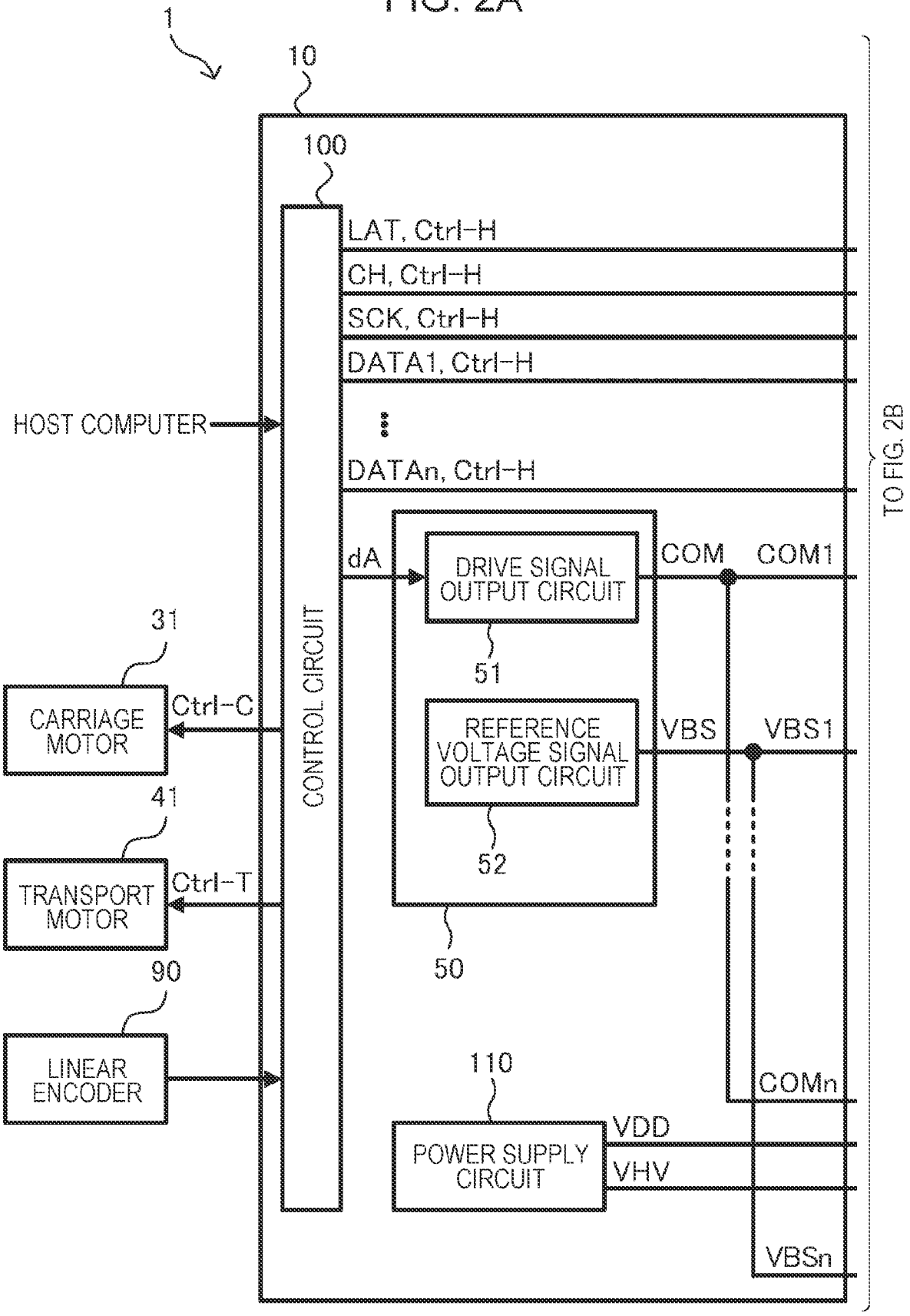
FIGS. 2A and 2B are diagrams illustrating a functional configuration of the printing apparatus.
Figure 2B:
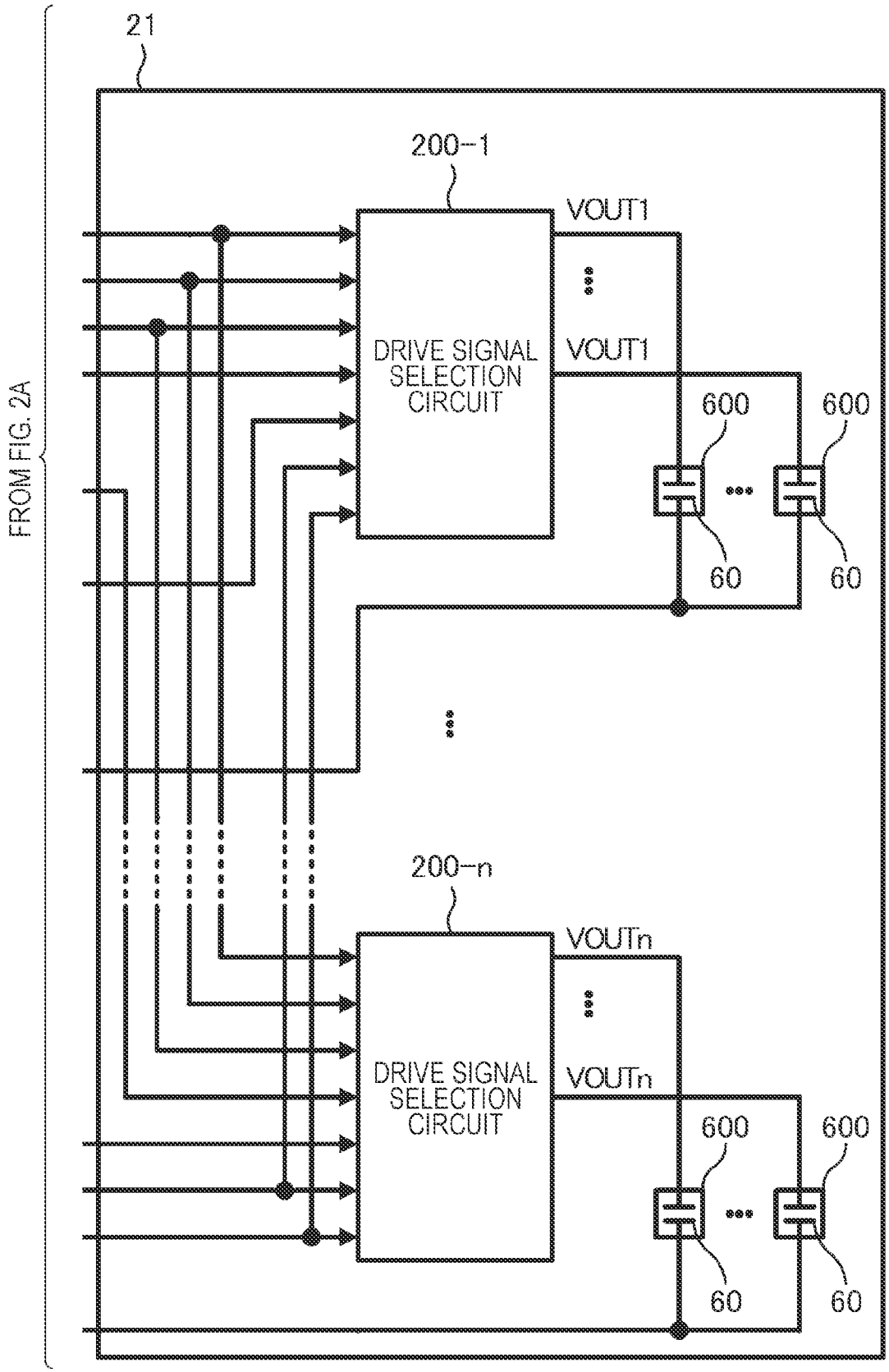

Next, a functional configuration of the printing apparatus 1 will be described. FIGS. 2A and 2B are diagrams illustrating a functional configuration of the printing apparatus 1. The printing apparatus 1 is provided with a control mechanism 10, a print head 21, a carriage motor 31, a transport motor 41, and a linear encoder 90.

The control mechanism 10 includes a drive circuit 50, a control circuit 100, and a power supply circuit 110. The control circuit 100 includes a processor such as a microcontroller, for example. The control circuit 100 generates various data for controlling the printing apparatus 1 and signals based on the data based on various signals such as image data input from the host computer, and outputs the signals to the corresponding configurations.

A specific example of the operation of the control circuit 100 will be described. The control circuit 100 grasps a scanning position of the print head 21 based on a detection signal input from the linear encoder 90. The control circuit 100 generates and outputs various signals according to the scanning position of the print head 21. Specifically, the control circuit 100 generates a control signal Ctrl-C for controlling the reciprocating movement of the print head 21 and outputs the control signal Ctrl-C to the carriage motor 31. In addition, the control circuit 100 generates a control signal Ctrl-T for controlling the transport of the medium P, and outputs the control signal Ctrl-T to the transport motor 41. The control signal Ctrl-C may be input to the carriage motor 31 after being signal-converted via a driver circuit (not illustrated). Similarly, the control signal Ctrl-T may be input to the transport motor 41 after being signal-converted via a driver circuit (not illustrated).

In addition, the control circuit 100 generates ejection control signals DATA1 to DATAn, a change signal CH, a latch signal LAT, and a clock signal SCK as control signals Ctrl-H for controlling the print head 21 based on various signals such as image data input from the host computer and the scanning position of the print head 21, and outputs these signals to the print head 21.

In addition, the control circuit 100 outputs a drive control signal dA, which is a digital signal, to the drive circuit 50.

The drive circuit 50 includes a drive signal output circuit 51 and a reference voltage signal output circuit 52. The drive control signal dA is input to the drive signal output circuit 51. The drive signal output circuit 51 converts the drive control signal dA into a digital or analog signal, and then amplifies the converted analog signal in class D to generate a drive signal COM. That is, the drive control signal dA is a digital signal that defines the waveform of the drive signal COM, and the drive signal output circuit 51 generates and outputs the drive signal COM by amplifying the waveform defined by the drive control signal dA in class D. Therefore, the drive control signal dA may be any signal that can define the waveform of the drive signal COM, and for example, the drive control signal dA may be an analog signal. Furthermore, the drive signal output circuit 51 may be able to amplify the waveform defined by the drive control signal dA, and may be, for example, an amplifier circuit in class A, an amplifier circuit in class B, an amplifier circuit in class AB, or the like.

The reference voltage signal output circuit 52 outputs a reference voltage signal VBS indicating the reference potential of the drive signal COM. The reference voltage signal VBS may be, for example, a signal having a ground potential having a voltage value of 0 V, or a signal having a DC voltage having a voltage value of 5.5 V or 6 V.

The drive signal COM and the reference voltage signal VBS are branched by the control mechanism 10 and then output to the print head 21. Specifically, the drive signal COM is branched into n drive signals COM1 to COMn corresponding to each of the n drive signal selection circuits 200 included in the print head 21 described later in the control mechanism 10, and then output to the print head 21. Similarly, the reference voltage signal VBS is branched into n reference voltage signals VBS1 to VBSn included in the print head 21 in the control mechanism 10 and then output to the print head 21. The drive signal COM and the drive signals COM1 to COMn to which the drive signal COM is branched are examples of the drive signal.

The power supply circuit 110 generates and outputs voltages VHV and VDD. The voltage VHV is a signal having a DC voltage having a voltage value of, for example, 42 V, and is used as a voltage for amplification in the drive signal output circuit 51 or the like. In addition, the voltage VDD is a signal having a DC voltage having a voltage value of, for example, 3.3 V, and is used as a power supply voltage, a control voltage, or the like of various configurations in the control mechanism 10. In addition, the voltages VHV and VDD are also output to the print head 21. The voltage values of the voltages VHV and VDD are not limited to the above-described 42V and 3.3V. In addition, the power supply circuit 110 may generate and output signals having a plurality of voltage values other than the voltages VHV and VDD.

As described above, the control circuit 100 generates various signals for controlling the operation of the print head 21 and outputs these signals to the print head 21. An example of the control signal output circuit is a control circuit 100 that outputs a plurality of signals including the ejection control signals DATA1 to DATAn, the change signal CH, the latch signal LAT, and the clock signal SCK.

The print head 21 includes drive signal selection circuits 200-1 to **200-*n* and a plurality of ejection portions 600**.

Each of the drive signal selection circuits 200-1 to **200-*n* is configured as, for example, an integrated circuit device. The voltages VHV and VDD, the corresponding drive signals COM1 to COMn, the corresponding ejection control signals DATA1 to DATAn, the clock signal SCK, the latch signal LAT, and the change signal CH are input to each of the drive signal selection circuits 200-1 to 200-*n*. The voltages VHV and VDD function as power supply voltages and control voltages of the drive signal selection circuits 200-1 to 200-*n*, respectively. Each of the drive signal selection circuits 200-1 to 200-*n* generates drive signals VOUT1 to VOUTn by selecting or not selecting the drive signals COM1 to COMn based on the input ejection control signals DATA1** to DATAn, the clock signal SCK, the latch signal LAT, and the change signal CH.

The drive signals VOUT1 to VOUTn generated by each of the drive signal selection circuits 200-1 to **200-*n* are supplied to the piezoelectric element 60 included in the corresponding ejection portion 600. The piezoelectric element 60 is driven by being supplied with the drive signals VOUT1 to VOUTn. An amount of ink corresponding to the displacement of the piezoelectric element 60 generated by driving the piezoelectric element 60 is ejected from the ejection portion 600**.

Specifically, the drive signal COM1, the ejection control signal DATA1, the latch signal LAT, the change signal CH, and the clock signal SCK are input to the drive signal selection circuit 200-1. The drive signal selection circuit 200-1 generates a drive signal VOUT1 by selecting or not selecting the waveform of the drive signal COM1 based on the ejection control signal DATA1, the latch signal LAT, the change signal CH, and the clock signal SCK, and outputs the drive signal VOUT1 to one end of the piezoelectric element 60 included in the corresponding ejection portion 600. In addition, a reference voltage signal VBS1 is supplied to the other end of the piezoelectric element 60. The piezoelectric element 60 is displaced by the potential difference between the drive signal VOUT1 and the reference voltage signal VBS1.

Similarly, the drive signal COMi, the ejection control signal DATAi, the latch signal LAT, the change signal CH, and the clock signal SCK are input to the drive signal selection circuit **200-*i* (i is any one of 1 to n). The drive signal selection circuit 200-*i* generates a drive signal VOUTi by selecting or not selecting the waveform of the drive signal COMi based on the ejection control signal DATAi, the latch signal LAT, the change signal CH, and the clock signal SCK, and outputs the drive signal VOUTi to one end of the piezoelectric element 60 included in the corresponding ejection portion 600. In addition, a reference voltage signal VBSi is supplied to the other end of the piezoelectric element 60. The piezoelectric element 60** is displaced by the potential difference between the drive signal VOUTi and the reference voltage signal VBSi.

Here, each of the drive signal selection circuits 200-1 to **200-*n* has a similar circuit configuration. Therefore, when it is not necessary to distinguish the drive signal selection circuits 200-1 to 200-*n* in the following description, the drive signal selection circuits 200-1 to 200-*n* may be referred to as a drive signal selection circuit 200. The drive signals COM1 to COMn input to the drive signal selection circuit 200 are referred to as a drive signal COM, the ejection control signals DATA1 to DATAn are referred to as an ejection control signal DATA, and the drive signals VOUT1 to VOUTn output from the drive signal selection circuit 200** are referred to as a drive signal VOUT.

In addition, the print head 21 in the present embodiment will be described as including 10 drive signal selection circuits 200. That is, in the following description, the print head 21 will be described as including the drive signal selection circuits 200-1 to 200-10. The number of drive signal selection circuits 200 included in the print head 21 is not limited to 10. In addition, the details of the operation of the drive signal selection circuit 200 will be described later.

3. Configuration of Ejection Portion

Figure 3:
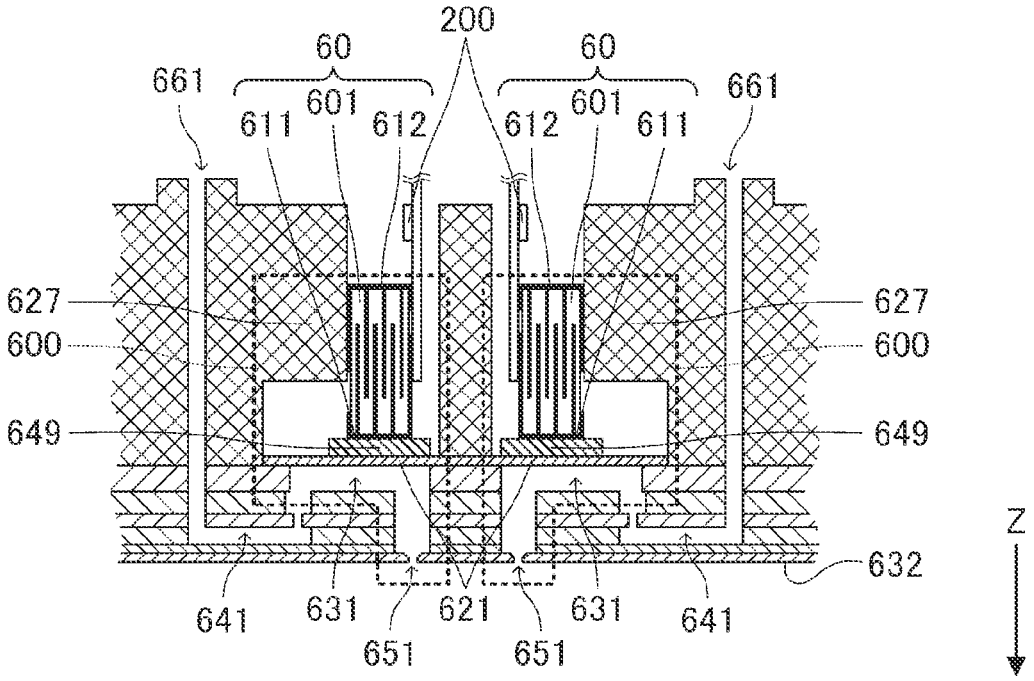
FIG. 3 is a diagram illustrating a schematic configuration of an ejection portion.

Next, a configuration of the ejection portion 600 will be described with reference to FIGS. 3 and 4. FIG. 3 is a diagram illustrating a schematic configuration of the ejection portion 600. As illustrated in FIG. 3, the ejection portion 600 includes a piezoelectric element 60, a diaphragm 621, a cavity 631, and a nozzle 651.

The piezoelectric element 60 is a laminated piezoelectric vibrator in which a piezoelectric body 601 is sandwiched between electrodes 611 and 612 and laminated, and cut into elongated comb-teeth shapes. The drive signal VOUT is supplied to the electrode 611, and the reference voltage signal VBS is supplied to the electrode 612. Such a piezoelectric element 60 functions as a longitudinal vibration type piezoelectric vibrator that is displaced in the vertical direction in FIG. 3, which is the longitudinal direction of the piezoelectric element 60, depending on the potential difference between the drive signal VOUT supplied to the electrode 611 and the reference voltage signal VBS supplied to the electrode 612. In addition, a fixed end portion of the piezoelectric element 60 is joined to a fixed portion 627, and a free end portion of the piezoelectric element 60 projects outward from a tip end edge of the fixed portion 627. That is, the piezoelectric element 60 is provided in a so-called cantilever state in the ejection portion 600. In addition, a tip end surface of the free end portion of the piezoelectric element 60 is joined to an island portion 649 provided above the diaphragm 621.

The diaphragm 621 is deformed with the displacement of the piezoelectric element 60 provided via the island portion 649 provided above in FIG. 3. In addition, the cavity 631 is provided below the diaphragm 621 in FIG. 3. That is, the diaphragm 621 functions as a diaphragm that expands or reduces the internal volume of the cavity 631 by deforming with the displacement of the piezoelectric element 60. The inside of the cavity 631 is filled with ink supplied through an ink supply port 661 and a reservoir 641. The cavity 631 functions as a pressure chamber whose internal volume changes due to the displacement of the piezoelectric element 60. The nozzle 651 is formed in a nozzle plate 632 and is an opening portion communicating with the cavity 631. The ink stored inside the cavity 631 is ejected from the nozzle 651 depending on the change in the internal volume of the cavity 631.

In the ejection portion 600 configured as described above, when the voltage of the drive signal VOUT increases, the piezoelectric element 60 is displaced upward. The piezoelectric element 60 is displaced upward, so that the internal volume of the cavity 631 is expanded. Therefore, the ink is drawn from the reservoir 641. On the other hand, when the voltage of the drive signal VOUT decreases, the piezoelectric element 60 is displaced downward. The piezoelectric element 60 is displaced downward, so that the internal volume of the cavity 631 is reduced. Therefore, an amount of ink corresponding to the degree of reduction in the internal volume of the cavity 631 is ejected from the nozzle 651. That is, the ejection portion 600 includes the piezoelectric element 60 driven by supplying the drive signal VOUT based on the drive signal COM, and ejects the ink as a liquid on the medium P as the piezoelectric element 60 is driven. The piezoelectric element 60 may be configured to be displaced downward when the voltage of the drive signal VOUT increases, and to be displaced upward when the voltage of the drive signal VOUT decreases.

A plurality of nozzles 651 included in the ejection portion 600 configured as described above are provided side by side on the nozzle plate 632.

Figure 4:
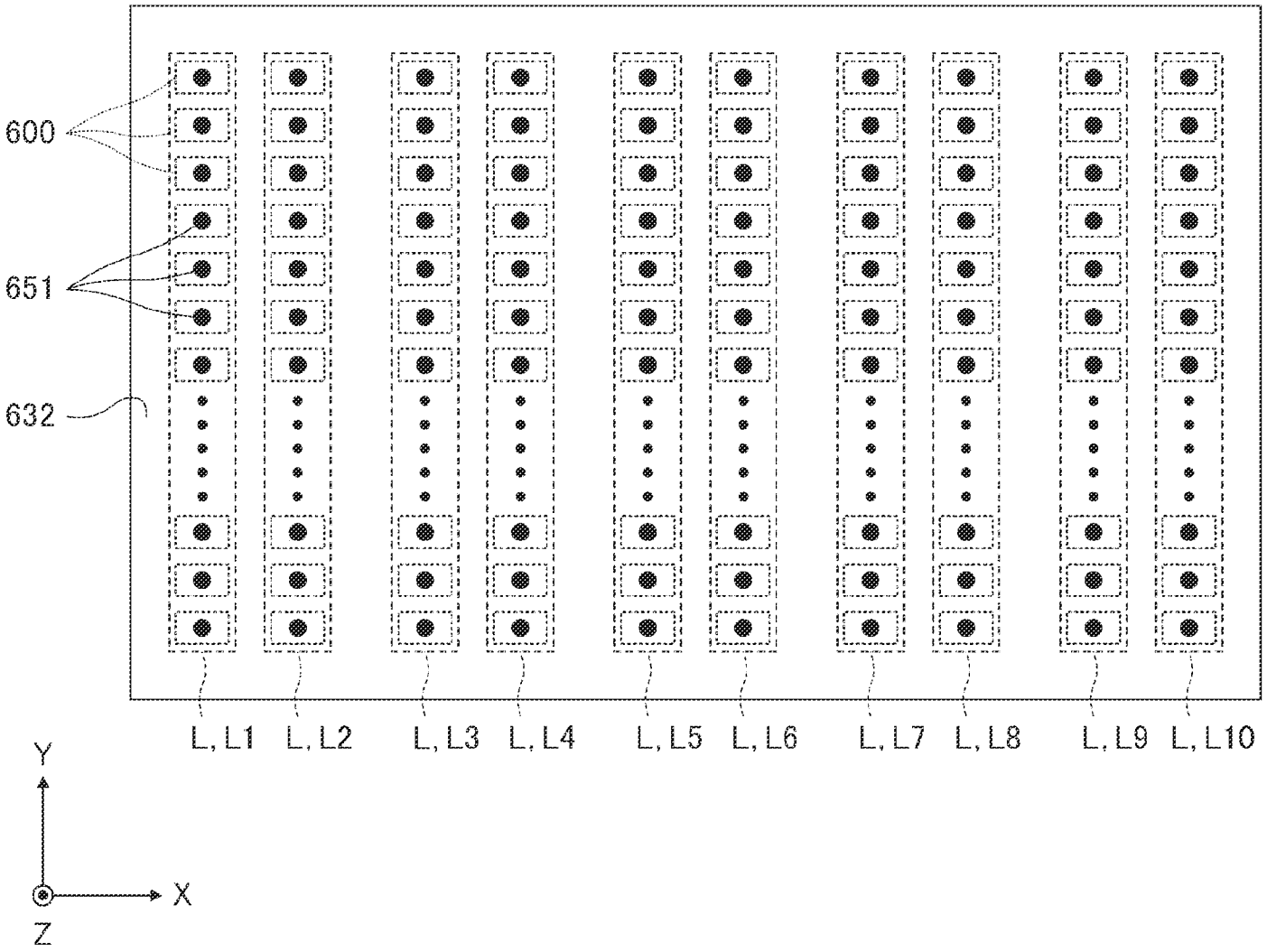
FIG. 4 is a diagram illustrating an example of an arrangement of nozzles provided on a nozzle plate.

FIG. 4 is a diagram illustrating an example of an arrangement of the nozzles 651 provided on the nozzle plate 632. As illustrated in FIG. 4, nozzle rows L in which m nozzles 651 are provided side by side along the Y direction are located in 10 rows along the X direction on the nozzle plate 632. Here, the ten nozzle rows L provided on the nozzle plate 632 may be referred to as nozzle rows L1 to L10 in order in the direction along the X direction. In addition, FIG. 4 illustrates a case where the nozzles 651 are provided side by side in one row in the Y direction in each of the nozzle rows L1 to L10, and the nozzles 651 may be provided side by side in two or more rows along the Y direction in each of the nozzle rows L1 to L10.

Each of the nozzle rows L1 to L10 provided on the nozzle plate 632 is provided corresponding to each of the drive signal selection circuits 200-1 to 200-10. Specifically, the drive signal VOUT1 output by the drive signal selection circuit 200-1 is supplied to one end of the m piezoelectric elements 60 included in the m ejection portions 600 provided in the nozzle row L1, and the reference voltage signal VBS1 is supplied to the other end of the piezoelectric element 60. Similarly, the drive signals VOUT2 to VOUT10 output by each of the drive signal selection circuits 200-2 to 200-10 are supplied to one end of the m piezoelectric elements 60 included in the m ejection portions 600 provided in each of the nozzle rows L2 to L10, and each of the reference voltage signals VBS2 to VBS10 are supplied to the other end of the corresponding piezoelectric element 60.

Here, each of the nozzle rows L1 to L10 in the present embodiment includes 150 or more nozzles 651 and the ejection portion 600. That is, the print head 21 includes 1500 or more ejection portions 600. The ejection control signal DATA1 output by the control circuit 100 includes information corresponding to 150 or more ejection portions 600, and the drive signal selection circuit 200-1 outputs the drive signal VOUT1 corresponding to each of the 150 or more ejection portions 600 defined by the ejection control signal DATA1. Similarly, each of the ejection control signals DATA2 to DATA10 output by the control circuit 100 includes information corresponding to 150 or more ejection portions 600, and each of the drive signal selection circuits 200-2 to 200-10 outputs the drive signals VOUT2 to VOUT10 defined by the ejection control signals DATA2 to DATA10 to each of the corresponding ejection portions 600.

As described above, the print head 21 in the present embodiment includes the ejection portion 600 including 1500 or more piezoelectric elements 60 and the nozzles 651. In other words, the print head 21 includes the 1500 or more piezoelectric elements 60 and the nozzles 651. The control circuit 100 outputs the ejection control signals DATA1 to DATA10 including information corresponding to each of the 1500 or more ejection portions 600 of the print head 21.

4. Example of Drive Signal COM and Drive Signal VOUT

Next, an example of the waveform of the drive signal COM generated by the drive signal output circuit 51 and input to the drive signal selection circuit 200, and an example of the waveform of the drive signal VOUT generated by the drive signal selection circuit 200 will be described with reference to FIGS. 5 and 6.

Figure 5:
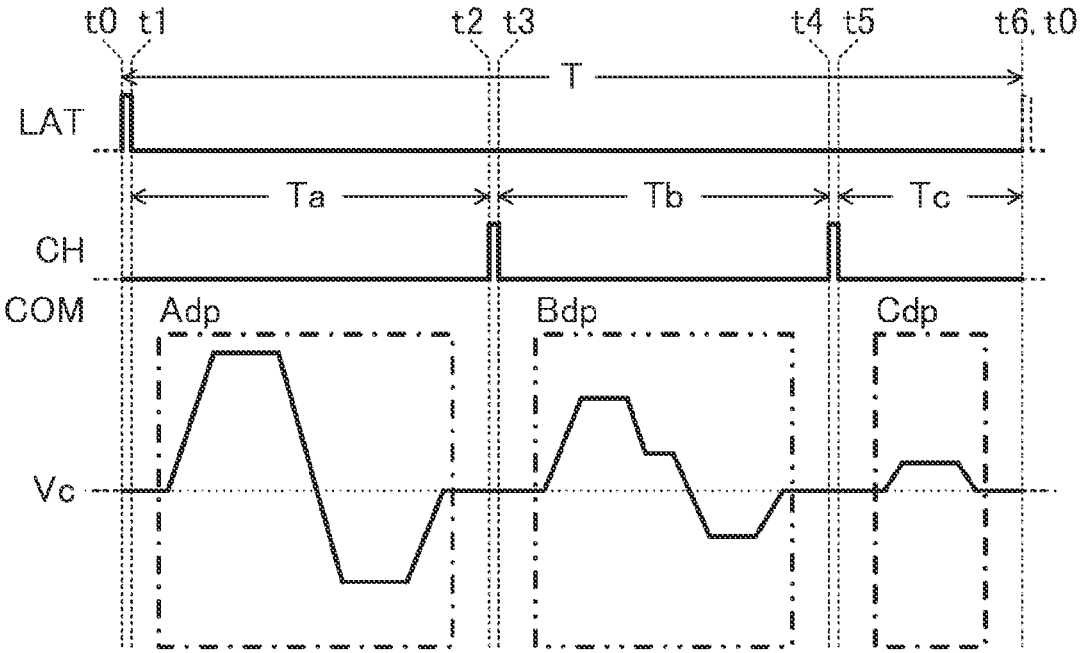
FIG. 5 is a graph illustrating an example of a waveform of a drive signal COM.

FIG. 5 is a graph illustrating an example of a waveform of the drive signal COM. As illustrated in FIG. 5, the drive signal COM is a signal having a continuous waveform of trapezoidal waveforms Adp, Bdp, and Cdp arranged in a cycle T from the rise of the latch signal LAT at time t0 to the rise of the next latch signal LAT at time t6. In addition, the voltage values at the start timing and end timing of the trapezoidal waveforms Adp, Bdp, and Cdp are all common to the voltage Vc. That is, each of the trapezoidal waveforms Adp, Bdp, and Cdp is a waveform that starts at the voltage Vc and ends at the voltage Vc.

In addition, the control circuit 100 raises the change signal CH at time t2 between the period when the drive signal output circuit 51 outputs the trapezoidal waveform Adp and the period when the drive signal output circuit 51 outputs the trapezoidal waveform Bdp, and lowers the change signal CH at time t3 between the period for outputting the trapezoidal waveform Adp and the period for outputting the trapezoidal waveform Bdp. Similarly, the control circuit 100 raises the change signal CH at time t4 between the period when the drive signal output circuit 51 outputs the trapezoidal waveform Bdp and the period when the drive signal output circuit 51 outputs the trapezoidal waveform Cdp, and lowers the change signal CH at time t5 between the period for outputting the trapezoidal waveform Bdp and the period for outputting the trapezoidal waveform Cdp. That is, the trapezoidal waveform Adp is arranged at a period Ta between the time t1 when the latch signal LAT falls after the latch signal LAT rises at time t0 and the time t2 when the change signal CH rises. The trapezoidal waveform Bdp is arranged at a period Tb between the time t3 when the change signal CH falls and the time t4 when the change signal CH rises next. The trapezoidal waveform Cdp is arranged at a period Tc between the time t5 when the change signal CH falls and the time t6 when the latch signal LAT rises. Here, the time t6 corresponds to the above-described time t0. That is, the drive signal COM is a waveform that repeatedly includes the trapezoidal waveforms Adp, Bdp, and Cdp in the cycle T defined by the latch signal LAT.

When the trapezoidal waveform Adp is supplied to the electrode 611, which is one end of the piezoelectric element 60, a medium amount of ink is ejected from the ejection portion 600 corresponding to the piezoelectric element 60. In addition, when the trapezoidal waveform Bdp is supplied to the electrode 611, which is one end of the piezoelectric element 60, a small amount of ink less than a medium amount is ejected from the ejection portion 600 corresponding to the piezoelectric element 60. In addition, when the trapezoidal waveform Cdp is supplied to the electrode 611, which is one end of the piezoelectric element 60, the ink is not ejected from the ejection portion 600 corresponding to the piezoelectric element 60, and the ink in the vicinity of the nozzle opening portion of the ejection portion 600 is slightly vibrated to prevent an increase in ink viscosity. That is, the trapezoidal waveform Cdp is a waveform for slightly vibrating the ejection portion 600.

As described above, the drive signal COM includes the trapezoidal waveforms Adp and Bdp that drive the piezoelectric element 60 so as to eject the ink from the ejection portion 600, and the trapezoidal waveform Cdp that drives the piezoelectric element 60 so that the ink is not ejected from the ejection portion 600. Here, the trapezoidal waveform Adp is an example of a first drive waveform, and the trapezoidal waveform Cdp is an example of a second drive waveform.

Figure 6:
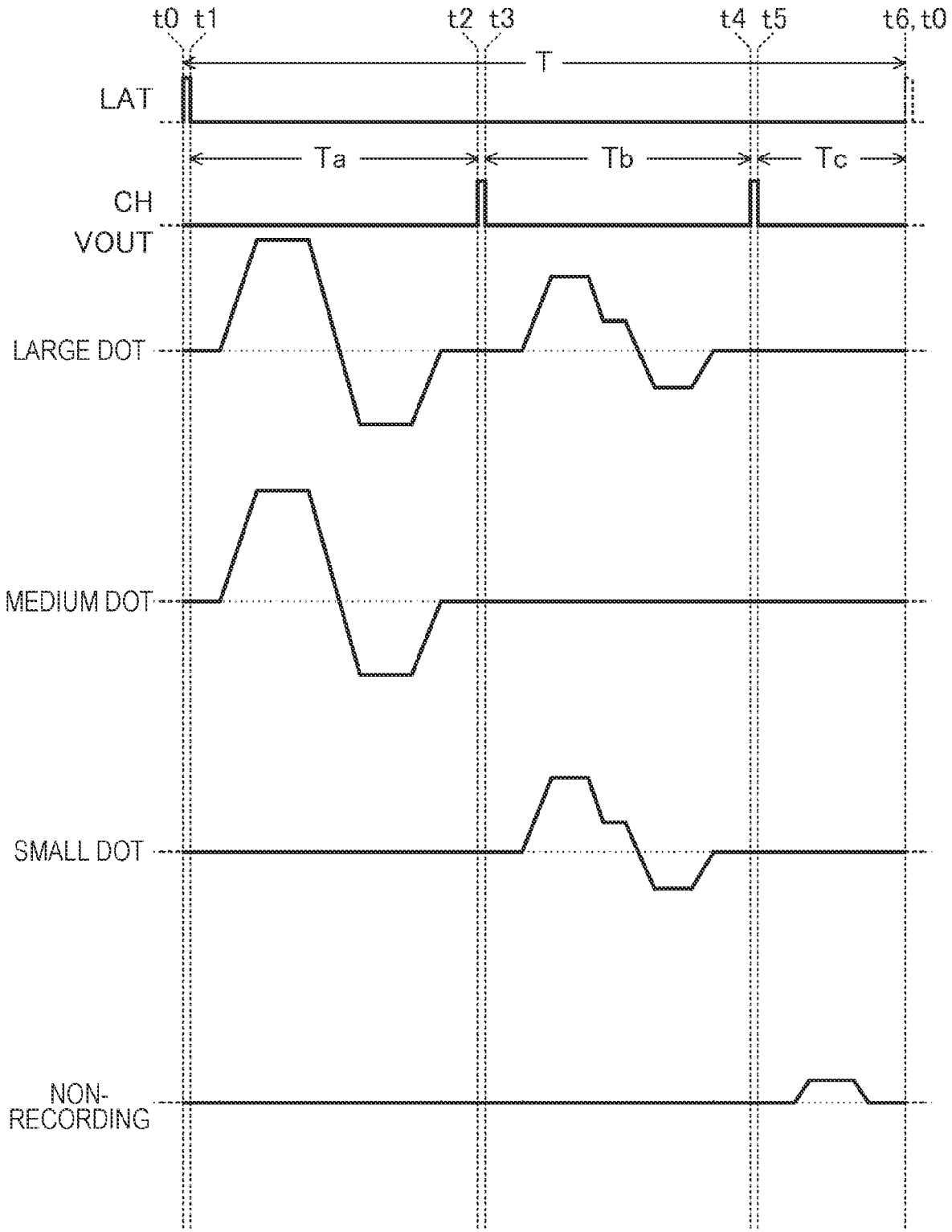
FIG. 6 is a graph illustrating an example of a waveform of a drive signal VOUT.

FIG. 6 is a graph illustrating an example of the waveform of the drive signal VOUT corresponding to the case where each of "large dot", "medium dot", "small dot", and "non-recording" is formed on the medium P by the ink ejected from the ejection portion 600.

As illustrated in FIG. 6, the drive signal VOUT corresponding to the "large dot" is a waveform in which a trapezoidal waveform Adp arranged in the period Ta, a trapezoidal waveform Bdp arranged in the period Tb, and a constant waveform at a voltage Vc arranged in the period Tc are continuous in the cycle T. That is, when the drive signal selection circuit 200 selects the trapezoidal waveform Adp arranged in the period Ta, selects the trapezoidal waveform Bdp arranged in the period Tb, and does not select the trapezoidal waveform Cdp arranged in the period Tc in the cycle T, the drive signal selection circuit 200 outputs the drive signal VOUT corresponding to the "large dot" to the corresponding ejection portion 600. When the drive signal VOUT corresponding to the "large dot" is supplied to one end of the piezoelectric element 60, a medium amount of ink is ejected from the ejection portion 600 corresponding to the piezoelectric element 60 in the period Ta, a small amount of ink is ejected in the period Tb, and the ink is not ejected in the period Tc. Therefore, a medium amount of ink and a small amount of ink land, and the inks coalesce on the medium P in the cycle T. As a result, large dots are formed on the medium P.

In addition, the drive signal VOUT corresponding to the "medium dot" is a waveform in which a trapezoidal waveform Adp arranged in the period Ta, a constant waveform at a voltage Vc arranged in the period Tb, and a constant waveform at a voltage Vc arranged in the period Tc are continuous in the cycle T. That is, when the drive signal selection circuit 200 selects the trapezoidal waveform Adp arranged in the period Ta, does not select the trapezoidal waveform Bdp arranged in the period Tb, and does not select the trapezoidal waveform Cdp arranged in the period Tc in the cycle T, the drive signal selection circuit 200 outputs the drive signal VOUT corresponding to the "medium dot" to the corresponding ejection portion 600. When the drive signal VOUT corresponding to the "medium dot" is supplied to one end of the piezoelectric element 60, a medium amount of ink is ejected from the ejection portion 600 corresponding to the piezoelectric element 60 in the period Ta, the ink is not ejected in the period Tb, and the ink is not ejected in the period Tc. Therefore, a medium amount of ink lands on the medium P in the cycle T. As a result, medium dots are formed on the medium P.

In addition, the drive signal VOUT corresponding to the "small dot" is a waveform in which a constant waveform at a voltage Vc arranged in the period Ta, a trapezoidal waveform Bdp arranged in the period Tb, and a constant waveform at a voltage Vc arranged in the period Tc are continuous in the cycle T. That is, when the drive signal selection circuit 200 does not select the trapezoidal waveform Adp arranged in the period Ta, selects the trapezoidal waveform Bdp arranged in the period Tb, and does not select the trapezoidal waveform Cdp arranged in the period Tc in the cycle T, the drive signal selection circuit 200 outputs the drive signal VOUT corresponding to the "small dot" to the corresponding ejection portion 600. When the drive signal VOUT corresponding to the "small dot" is supplied to one end of the piezoelectric element 60, the ink is not ejected from the ejection portion 600 corresponding to the piezoelectric element 60 in the period Ta, a small amount of ink is ejected in the period Tb, and the ink is not ejected in the period Tc. Therefore, a small amount of ink lands on the medium P in the cycle T, and as a result, small dots are formed on the medium P.

In addition, the drive signal VOUT corresponding to "non-recording" is a waveform in which a constant waveform at a voltage Vc arranged in the period Ta, a constant waveform at a voltage Vc arranged in the period Tb, and a trapezoidal waveform Cdp arranged in the period Tc are continuous in the cycle T. That is, when the drive signal selection circuit 200 does not select the trapezoidal waveform Adp arranged in the period Ta, does not select the trapezoidal waveform Bdp arranged in the period Tb, and selects the trapezoidal waveform Cdp arranged in the period Tc in the cycle T, the drive signal selection circuit 200 outputs the drive signal VOUT corresponding to "non-recording". When the drive signal VOUT corresponding to this "non-recording" is supplied to one end of the piezoelectric element 60, only the ink in the vicinity of the nozzle opening portion of the ejection portion 600 corresponding to the piezoelectric element 60 vibrates slightly, and the ink is not ejected from the ejection portion 600 corresponding to the piezoelectric element 60. Therefore, the ink does not land on the medium P in the cycle T. As a result, dots are not formed on the medium P.

Here, the constant waveform at the voltage Vc supplied to the electrode 611 of the piezoelectric element 60 is also a waveform including a voltage at which the immediately preceding voltage Vc is held by the capacitance component of the piezoelectric element 60 when none of the trapezoidal waveforms Adp, Bdp, and Cdp is selected as the drive signal VOUT. Therefore, when none of the trapezoidal waveforms Adp, Bdp, and Cdp is selected as the drive signal VOUT, the voltage Vc is supplied to the piezoelectric element 60 as the drive signal VOUT.

Here, the cycle T from the rise of the latch signal LAT illustrated in FIGS. 5 and 6 to the rise of the next latch signal LAT corresponds to the printing cycle of forming new dots on the medium P. The drive signal COM and the drive signal VOUT illustrated in FIGS. 5 and 6 are merely examples, and various combinations of waveforms may be used depending on the moving speed of the carriage 20 on which the print head 21 is mounted, the physical properties of the ink supplied to the print head 21, and the material of the medium P, and the like.

5. Configuration and Operation of Selection Control Circuit

As described above, the drive signal selection circuit 200 selects or does not select the trapezoidal waveforms Adp, Bdp, and Cdp included in the drive signal COM, so that the drive signal VOUT is generated and output according to the size of the dots formed on the medium P. Here, the configuration and operation of the drive signal selection circuit 200 that outputs the drive signal VOUT will be described.

Figure 7A:
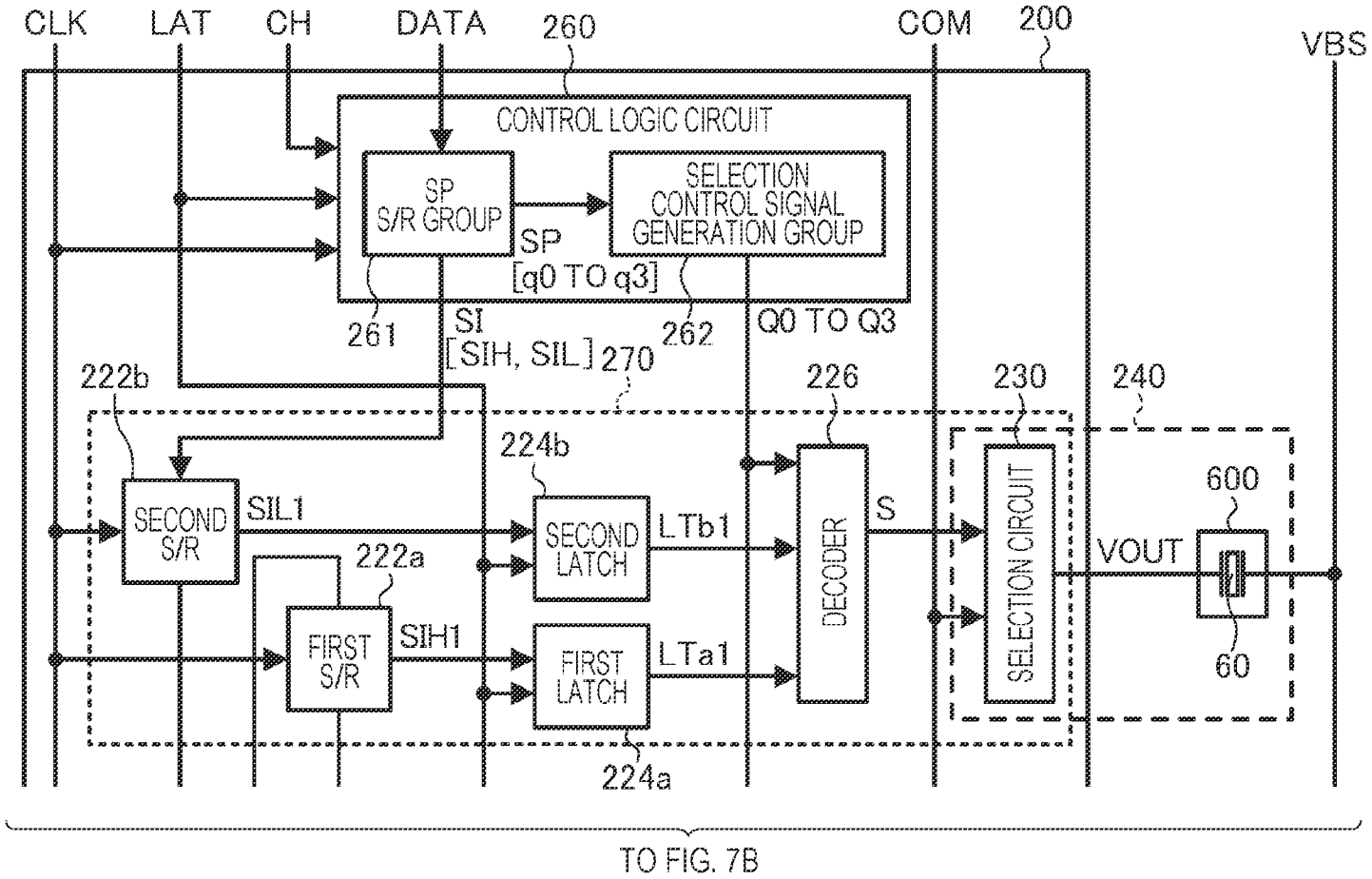
FIGS. 7A and 7B are diagrams illustrating a configuration of a drive signal selection circuit.
Figure 7B:
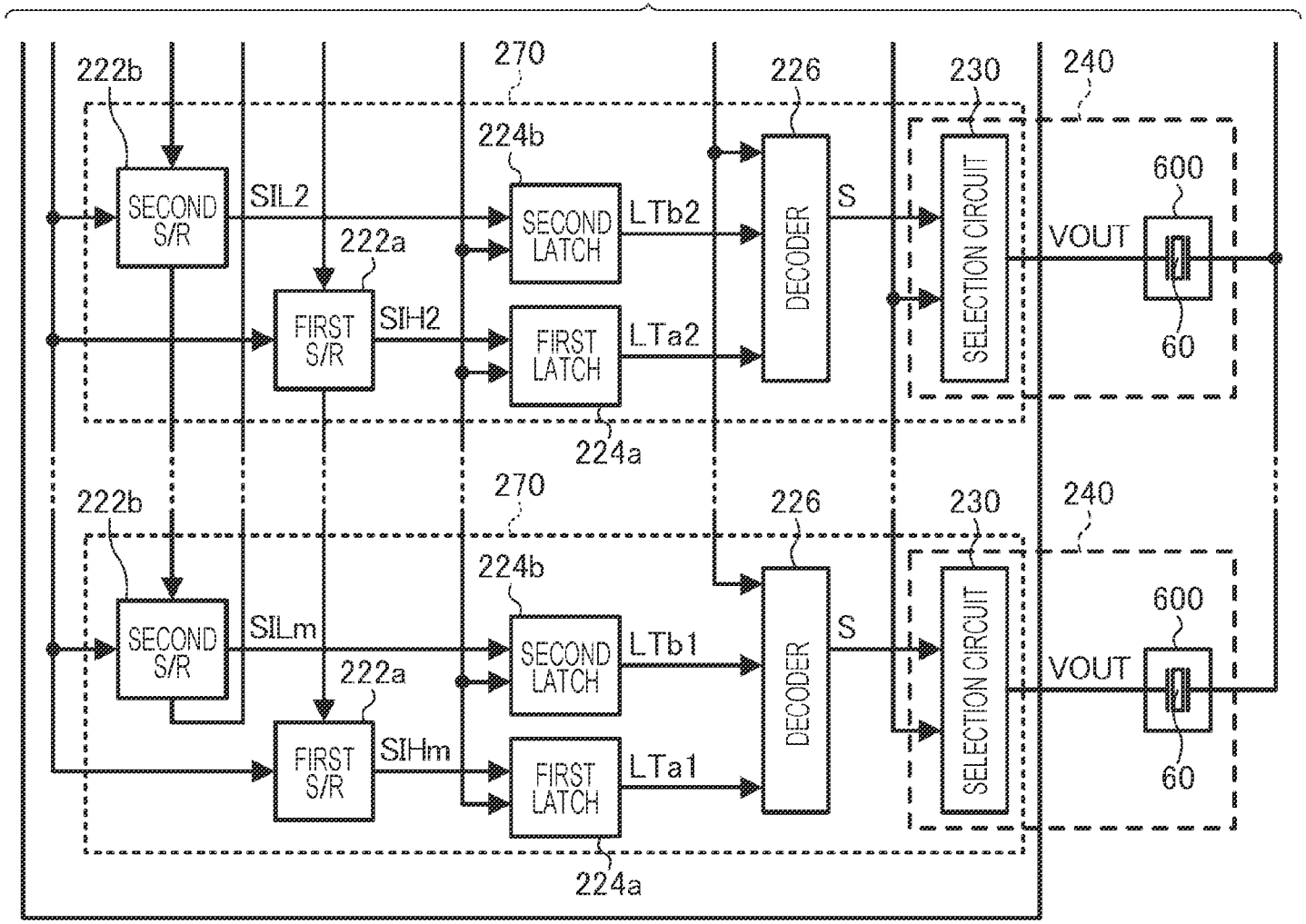

FIGS. 7A and 7B are diagrams illustrating a configuration of the drive signal selection circuit 200. As illustrated in FIGS. 7A and 7B, the drive signal selection circuit 200 includes a control logic circuit 260 and m selection control circuits 270 provided corresponding to the m ejection portions 600. That is, the drive signal selection circuit 200 includes the m selection control circuits 270 as many as the total number of ejection portions 600 that output the drive signal VOUT.

The ejection control signal DATA, the latch signal LAT, the change signal CH, the clock signal SCK, and the drive signal COM are input to the drive signal selection circuit 200. The drive signal selection circuit 200 generates a drive signal VOUT by selecting or not selecting the trapezoidal waveforms Adp, Bdp, and Cdp included in the drive signal COM based on the ejection control signal DATA, the latch signal LAT, the change signal CH, and the clock signal SCK, and outputs the drive signal VOUT to the corresponding ejection portion 600.

The control logic circuit 260 includes an SP shift register (S/R) group 261 and a selection control signal generation group 262. The SP shift register group 261 holds program data q0 to q3 included in a setting data signal SP described later in the ejection control signal DATA input in synchronization with the clock signal SCK. The selection control signal generation group 262 latches the program data q0 to q3 held in the SP shift register group 261 and outputs the latched program data q0 to q3 as the selection control signals Q0 to Q3 to a decoder 226.

The selection control circuit 270 includes a first shift register 222*a*, a second shift register 222*b*, a first latch circuit 224*a*, a second latch circuit 224*b*, a decoder 226, and a selection circuit 230. Here, in the following description, the m selection control circuits 270 included in the drive signal selection circuit 200 may be referred to as a first stage, second stage, . . . , and m-th stage in order from the upstream where the ejection control signal DATA is input. Similarly, each of the first shift register 222*a*, the second shift register 222*b*, the first latch circuit 224*a*, the second latch circuit 224*b*, the decoder 226, and the selection circuits 230 included in the selection control circuit 270 of the first stage, second stage, . . . , and m-th stage may be referred to as a first stage, second stage, . . . , and m-th stage.

Among the ejection control signals DATA input in synchronization with the clock signal SCK, higher print data SIH and lower print data SIL included in a print data signal SI described later are held in the first shift register 222*a* and the second shift register 222*b*. Although the details will be described later, the ejection control signal DATA includes the higher print data SIH and the lower print data SIL corresponding to each of the plurality of ejection portions 600 as the print data signal SI. Among the print data signal SI propagated in synchronization with the clock signal SCK, the higher print data SIH is held in the first shift register 222*a*, and the lower print data SIL is held in the second shift register 222*b*.

Here, in the following description, the higher print data SIH and the lower print data SIL corresponding to the ejection portion 600 may be referred to as print data [SIH, SIL]. In addition, the print data [SIH, SIL] corresponding to each of the ejection portions 600 of the first stage to m-th stage may be referred to as print data [SIH1, SIL1], print data [SIH2, SIL2], . . . , and print data [SIHm, SILm].

Here, as illustrated in FIGS. 7A and 7B, the SP shift register group 261, the first shift register 222*a*, and the second shift register 222*b* are connected to each other in series in the drive signal selection circuit 200. Specifically, the SP shift register group 261, the first shift register 222*a*, and the second shift register 222*b* are connected to each other in series in the order of the SP shift register group 261, the second shift register 222*b* corresponding to each of the first stage to m-th stage, and the first shift register 222*a* corresponding to each of the first stage to m-th stage in the drive signal selection circuit 200. Therefore, the ejection control signal DATA is transferred in the order of the SP shift register group 261, the second shift register 222*b* corresponding to each of the first stage to m-th stage, and the first shift register 222*a* corresponding to each of the first stage to m-th stage according to the clock signal SCK. That is, the clock signal SCK sequentially propagates the ejection control signal DATA to the shift register in the subsequent stage. In other words, the clock signal SCK is a signal that defines a propagation timing of the ejection control signal DATA.

Figure 8:
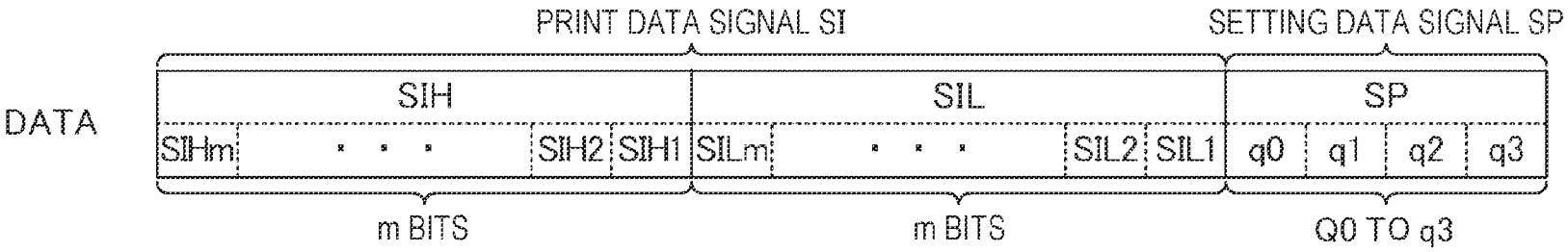
FIG. 8 is a table illustrating an example of a data format of an ejection control signal.

Here, an example of a data format of the ejection control signal DATA will be described. The ejection control signal DATA is a signal that serially includes the setting data signal SP held in the SP shift register group 261, the higher print data SIH held in the first shift register 222*a*, and the lower print data SIL held in the second shift register 222*b* in the order of the higher print data SIH corresponding to each of the ejection portions 600 of the m-th stage to first stage, the lower print data SIL corresponding to each of the ejection portions 600 of the m-th stage to first stage, and the program data q0 to q3. FIG. 8 is a table illustrating an example of the data format of the ejection control signal DATA. As illustrated in FIG. 8, the ejection control signal DATA includes the setting data signal SP and the print data signal SI. In addition, the print data signal SI includes the higher print data SIH and the lower print data SIL.

The print data signal SI is a serial signal including data of a total of 2m bits including data of two bits of the higher print data SIH and the lower print data SIL for controlling the drive of piezoelectric element 60 included in the ejection portion 600 corresponding to each of m ejection portions 600. The setting data signal SP is a serial signal including data for defining the drive pattern of the piezoelectric element 60. Specifically, the setting data signal SP serially includes four program data q0 to q3 indicating the drive pattern of the piezoelectric element 60 determined by the combination of the higher print data SIH and the lower print data SIL included in the print data signal SI. Each of the program data q0 to q3 included in the setting data signal SP may include data of a plurality of bits for defining the drive pattern of the piezoelectric element 60.

Returning to FIGS. 7A and 7B, in the drive signal selection circuit 200, the ejection control signal DATA as illustrated in FIG. 8 is sequentially transferred by the SP shift register group 261, the second shift register 222*b*, and the first shift register 222*a* in synchronization with the clock signal SCK. As a result, the program data g0 to q3 included in the setting data signal SP are held in the SP shift register group 261. The lower print data SIL corresponding to each of the ejection portions 600 of the first stage to m-th stage is held in the second shift register 222*b*. The higher print data SIH corresponding to each of the ejection portions 600 of the first stage to m-th stage is held in the first shift register 222*a*.

The higher print data SIH corresponding to each of the ejection portions 600 of the first stage to m-th stage held in the first shift register 222*a* is latched by the first latch circuit 224*a* corresponding to each of the ejection portions 600 of the first stage to m-th stage at the rising of the latch signal LAT. In addition, the lower print data SIL corresponding to each of the ejection portions 600 of the first stage to m-th stage held in the second shift register 222*b* is latched by the second latch circuit 224*b* corresponding to each of the ejection portions 600 of the first stage to m-th stage at the rising of the latch signal LAT.

The first latch circuit 224*a* outputs the latched higher print data SIH as latch data LTa to the decoder 226, and the second latch circuit 224*b* outputs the latched lower print data SIL as latch data LTb to the decoder 226.

In the following description, the latch data LTa output by the first latch circuit 224*a* corresponding to each of the ejection portions 600 of the first stage, second stage, . . . , and m-th stage may be referred to as latch data LTa1, LTa2, . . . , and LTam. The latch data LTb output by the second latch circuit 224*b* corresponding to each of the ejection portions 600 of the first stage, second stage, . . . , and m-th stage may be referred to as latch data LTb1, LTb2, . . . , and LTbm. In addition, in the following description, the latch data LTa and LTb may be referred to as latch data [LTa, LTb], and the latch data [LTa, LTb] corresponding to each of the ejection portions 600 of the first stage, second stage, . . . , and m-th stage may be referred to as latch data [LTa1, LTb1], latch data [LTa2, LTb2], . . . , and latch data [LTam, LTbm].

The selection control signals Q0 to Q3 corresponding to the program data q0 to q3 and the latch data [LTa, LTb] corresponding to the print data [SIH, SIL] are input to the decoder 226. The decoder 226 generates a TG control signal S based on the selection control signals Q0 to Q3 and the latch data [LTa, LTb], and outputs the TG control signal S to the corresponding selection circuit 230. Here, the selection control signals Q0 to Q3 corresponding to the program data q0 to q3 are data defining the drive pattern of the piezoelectric element 60, and specifically, define a logic level of the TG control signal S to be output in each of the periods Ta, Tb, and Tc illustrated in FIGS. 5 and 6. In addition, the latch data [LTa, LTb] corresponding to the print data [SIH, SIL] is data for controlling the drive of piezoelectric element 60, and specifically, is a signal for selecting a drive pattern defined by the selection control signals Q0 to Q3 corresponding to the program data q0 to q3.

That is, the decoder 226 decodes the selection control signals Q0 to Q3 corresponding to the program data q0 to q3 based on the latch data [LTa, LTb] corresponding to the print data [SIH, SIL], and outputs the TG control signal S having a predetermined logic level in each of the periods Ta, Tb, and Tc. The TG control signal S output from the decoder 226 may be converted into a high-amplitude logic signal based on the voltage VHV by a level shifter (not illustrated).

Figures 9, 10:
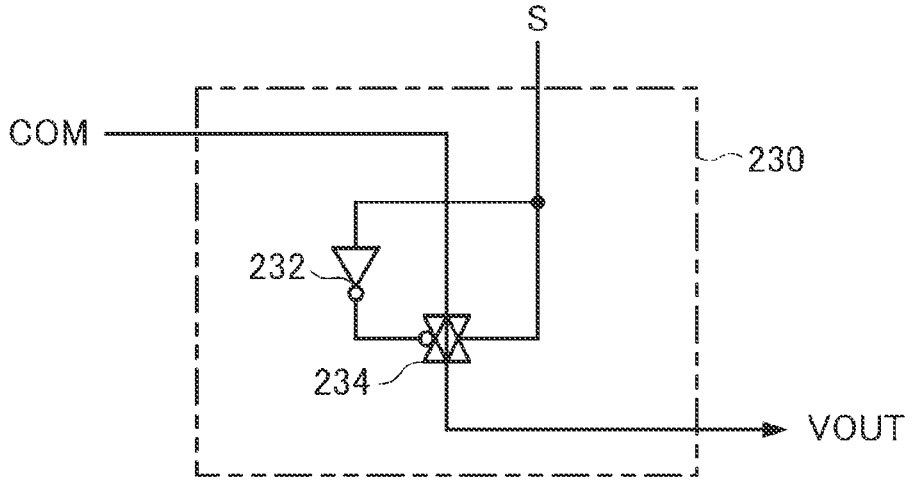
FIG. 9 is a table illustrating the decoding contents of a decoder.
FIG. 10 is a diagram illustrating a configuration of a selection circuit corresponding to one ejection portion.

FIG. 9 is a table illustrating the decoding contents of the decoder 226. As illustrated in FIG. 9, the selection control signal Q0 corresponding to the program data q0 defines the logic level of the TG control signal S as the H, H, and L level in each of the periods Ta, Tb, and Tc. The selection control signal Q1 corresponding to the program data q1 defines the logic level of the TG control signal S as the H, L, and L level in each of the periods Ta, Tb, and Tc. The selection control signal Q2 corresponding to the program data q2 defines the logic level of the TG control signal S as the L, H, and L level in each of the periods Ta, Tb, and Tc. The selection control signal Q3 corresponding to the program data q3 defines the logic level of the TG control signal S as the L, L, and H level in each of the periods Ta, Tb, and Tc.

The decoder 226 selects the selection control signals Q0 to Q3 based on the latch data [LTa, LTb] corresponding to the print data [SIH, SIL] latched by the first latch circuit 224*a* and the second latch circuit 224*b*, and outputs the TG control signal S having a corresponding logic level. For example, when the latch data [LTa, LTb] input to the decoder 226 is [1,0], the decoder 226 outputs the TG control signals S having H, L, and L level at each of the periods Ta, Tb, and Tc defined by the selection control signal Q1.

The TG control signal S output from the decoder 226 is input to the selection circuit 230. FIG. 10 is a diagram illustrating a configuration of the selection circuit 230 corresponding to one ejection portion 600. As illustrated in FIG. 10, the selection circuit 230 includes an inverter 232 which is a NOT circuit and a transfer gate 234. While the TG control signal S is input to a positive control end not marked with a circle at the transfer gate 234, the TG control signal S is logically inverted by the inverter 232 and input to a negative control end marked with a circle at the transfer gate 234. In addition, the drive signal COM is supplied to an input terminal of the transfer gate 234. Specifically, when the TG control signal S is at the H level, the transfer gate 234 makes the input terminal and an output terminal conductive, and when the TG control signal S is at the L level, the transfer gate 234 makes the input terminal and the output terminal non-conductive. The drive signal VOUT is output from the output terminal of the transfer gate 234. That is, the transfer gate 234 switches whether or not to supply the drive signal COM to the piezoelectric element 60 as the drive signal VOUT. In the following description, controlling to be conductive between the input terminal and the output terminal may be simply referred to as "turning on", and controlling to be non-conductive between the input terminal and the output terminal is simply referred to as "turning off".

As described above, the ejection control signal DATA, the latch signal LAT, the change signal CH, the clock signal SCK, and the drive signal COM are input to the drive signal selection circuit 200. By selecting or not selecting the drive signal COM based on the ejection control signal DATA, the latch signal LAT, the change signal CH, and the clock signal SCK, the drive signal VOUT as illustrated in FIGS. 2 and 7 is generated and output to the corresponding ejection portion 600.

Here, as described above, the drive signal selection circuit 200 is provided with m selection control circuits 270 corresponding to m ejection portions 600. Each of the m selection control circuits 270 includes the first shift register 222*a*, the second shift register 222*b*, the first latch circuit 224*a*, the second latch circuit 224*b*, the decoder 226, and the selection circuit 230. That is, the drive signal selection circuit 200 includes m first shift registers 222*a, m* second shift registers 222*b, m* first latch circuits 224*a, m* second latch circuits 224*b, m* decoders 226, and m selection circuits 230.

In addition, as illustrated in FIGS. 2A and 2B are diagrams, the print head 21 is provided with n selection control circuits 270. That is, the print head 21 includes m×n first shift registers 222*a*, m×n second shift registers 222*b*, m×n first latch circuits 224*a*, and *m*×n second latch circuits 224*b*, m×n decoders 226, m×n selection circuits 230, and m×n ejection portions 600. Here, as described above, in the printing apparatus 1 of the present embodiment, the print head 21 includes 10 selection control circuits 270, and the drive signal selection circuit 200 outputs the drive signal VOUT to 150 or more ejection portions 600. That is, the print head 21 in the present embodiment includes 1500 or more first shift registers 222*a,* 1500 or more second shift registers 222*b,* 1500 or more first latch circuits 224*a,* 1500 or more second latch circuits 224*b,* 1500 or more decoders 226, 1500 or more selection circuits 230, and 1500 or more ejection portions 600.

In the print head 21 configured as described above, the transfer gate 234 included in the selection circuit 230 for switching whether or not to supply the drive signal COM to the piezoelectric element 60 is an example of a changeover switch. The configuration including the selection circuit 230 including the transfer gate 234 and the ejection portion 600 corresponds to an ejection module 240. That is, the print head 21 includes 1500 or more ejection modules 240 including the selection circuit 230 including the transfer gate 234 and the ejection portion 600 corresponding to each of the 1500 or more ejection portions 600. The ejection control signal DATA, the latch signal LAT, the change signal CH, the clock signal SCK, and the drive signal COM for driving the 1500 or more ejection modules 240 are output from the control mechanism 10. This control mechanism 10 is an example of a print head drive circuit.

The ejection control signal DATA for controlling the drive of 1500 or more piezoelectric elements 60 of the print head 21 is an example of the selection signal. The higher print data SIH included in the print data signal SI in the ejection control signal DATA is an example of drive data. The program data q0 to q3 included in the setting data signal SP in the ejection control signal DATA are examples of drive pattern data. In addition, as illustrated in FIG. 6, the drive signal selection circuit 200 switches whether or not to select the trapezoidal waveforms Adp, Bdp, and Cdp included in the drive signal COM in each of the periods Ta, Tb, and Tc defined by the latch signal LAT and the change signal CH, so that the drive signal VOUT supplied to the piezoelectric element 60 is generated. That is, each of the transfer gates 234 included in the m selection circuits 230 corresponding to each of the m ejection portions 600 switches from conductive to non-conductive or from non-conductive to conductive at the timing when the change signal CH and the latch signal LAT switch from the L level to the H level. In other words, the change signal CH and the latch signal LAT control each of the switching timings of the transfer gate 234. Of the change signal CH and the latch signal LAT, the change signal CH is an example of the switching timing signal, and the latch signal LAT is another example of the switching timing signal.

In the printing apparatus 1 of the present embodiment configured as described above, since the print head 21 includes the 1500 or more ejection portions 600, when the transfer gate 234 included in the selection circuit 230 corresponding to each of the 1500 or more ejection portions 600 is driven, a large current flows through the print head 21 as the transfer gate 234 is driven. Since a large current is generated when the transfer gate 234 is driven, there is a high possibility that noise due to the large current supplied to the print head 21, such as switching noise due to the drive of transfer gate 234, is generated. When the noise component due to the large current generated by driving the transfer gate 234 is superimposed on the print data [SIH, SIL] included in the ejection control signal DATA and the program data q0 to q3, there is a possibility that malfunction of the drive signal selection circuit 200 into which the ejection control signal DATA is input may be generated. As a result, the accuracy of the drive signal VOUT output from the drive signal selection circuit 200 is lowered. That is, in the printing apparatus 1 provided with the print head 21 having the 1500 or more ejection portions 600 as illustrated in the present embodiment, a large current is generated by driving the transfer gate 234 provided corresponding to the ejection portions 600. Therefore, there is a high possibility that the noise component due to the large current is superimposed on the ejection control signal DATA. As a result, there is a possibility that malfunction of the printing apparatus 1 may be generated and the printing quality of the printing apparatus 1 may be deteriorated.

In response to such a problem, the control circuit 100 included in the control mechanism 10 included in the printing apparatus 1 in the present embodiment stops the output of the ejection control signal DATA in the period of outputting the change signal CH for controlling the switching of the transfer gate 234. Therefore, the possibility is reduced that noise generated by switching the transfer gate 234 is superimposed on the ejection control signal DATA. In other words, the control circuit 100 included in the control mechanism 10 exclusively outputs a change signal CH for controlling the switching of the transfer gate 234, and an ejection control signal DATA for controlling the drive of 1500 or more piezoelectric elements 60. As a result, the possibility is reduced that the noise component based on a large current generated by driving the transfer gate 234 is superimposed on the ejection control signal DATA. As a result, the possibility is reduced that malfunction of the drive signal selection circuit 200 is generated, and the possibility is reduced that the accuracy of the drive signal VOUT output from the drive signal selection circuit 200 is deteriorated. Therefore, the possibility of malfunction of the printing apparatus 1 is reduced, and the possibility of deterioration of the printing quality of the printing apparatus 1 is reduced.

Here, a specific example of the timing at which the control circuit 100 included in the control mechanism 10 in the present embodiment outputs the ejection control signal DATA, the latch signal LAT, and the change signal CH to the drive signal selection circuit 200, and the operation of the drive signal selection circuit 200 will be described with reference to FIGS. 11A and 11B.

Figure 11A:
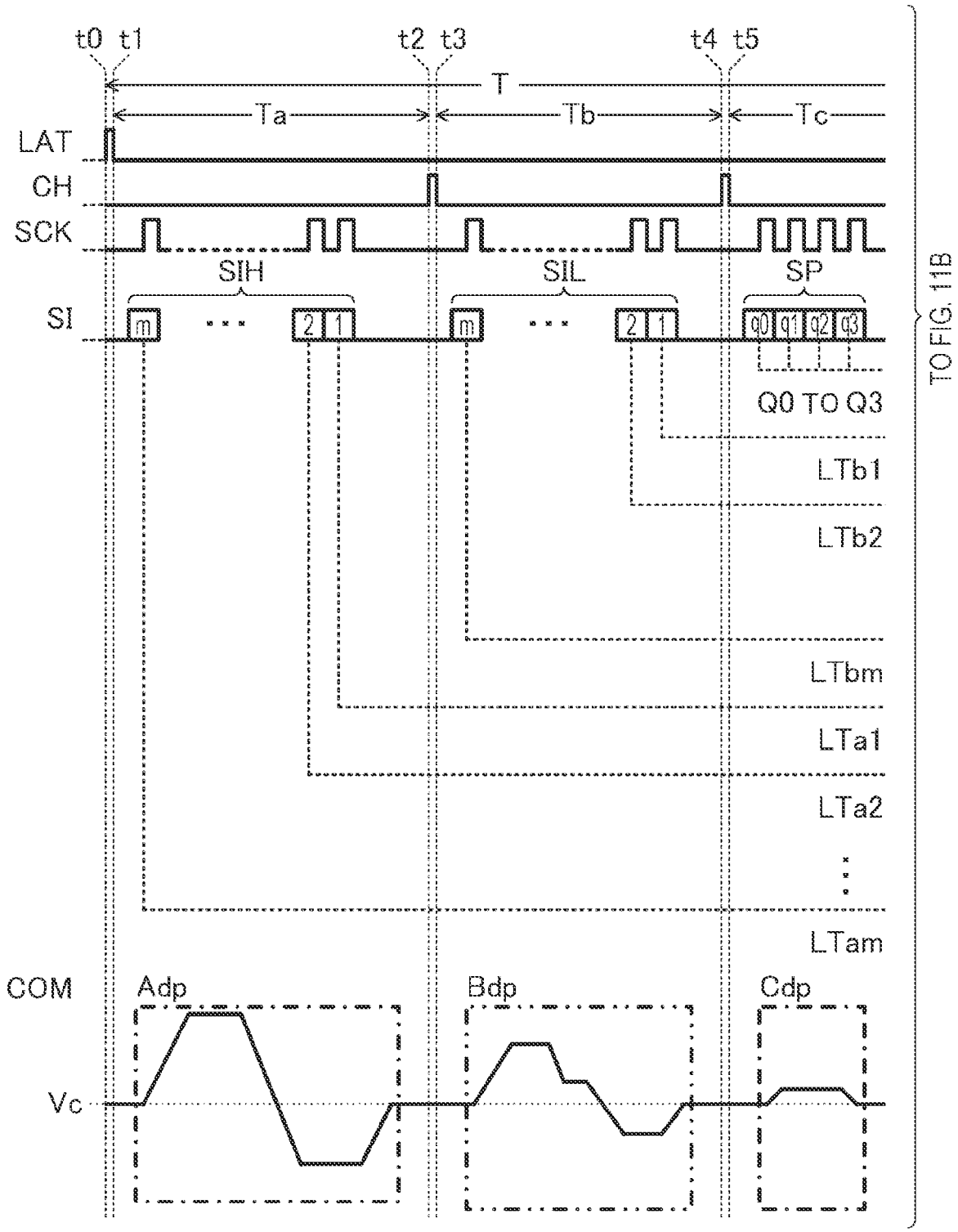
FIG. 11A is a first half of a graph for describing an operation of the drive signal selection circuit.
Figure 11B:
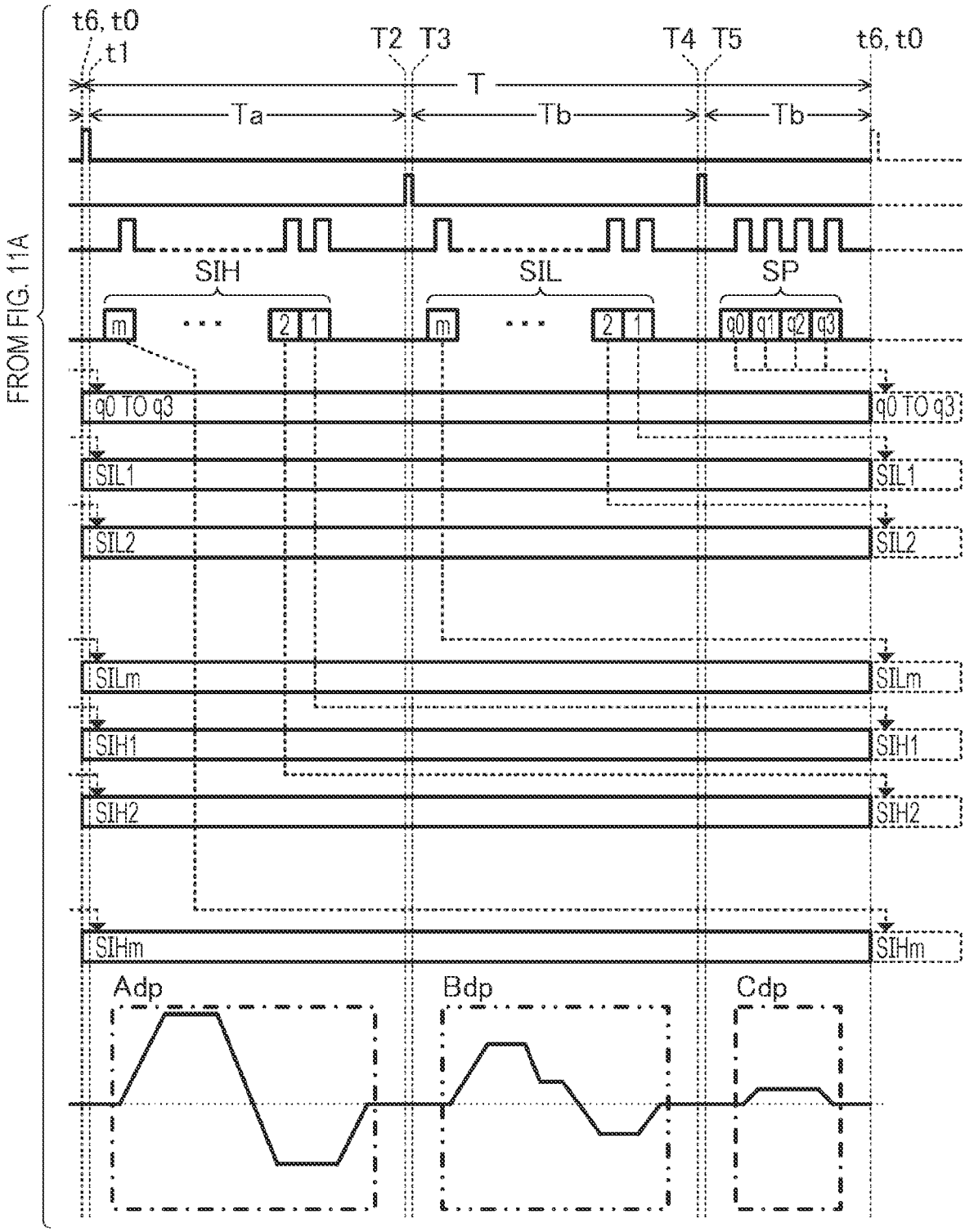
FIG. 11B is a second half of the graph for describing the operation of the drive signal selection circuit.

FIGS. 11A and 11B are a graph for describing the operation of the drive signal selection circuit 200. As illustrated in FIGS. 11A and 11B, in the period Ta between the time t1 at which the latch signal LAT falls and the time t2 at which the change signal CH rises, the control circuit 100 serially outputs the higher print data SIH included in the print data signal SI in the ejection control signal DATA in synchronization with the clock signal SCK. Therefore, in the period Ta between the time t1 and the time t2, the higher print data SIH included in the print data signal SI in the ejection control signal DATA is input to the drive signal selection circuit 200. In this case, the control circuit 100 continues to output the change signal CH having L level. Therefore, the transfer gate 234 continues to be an on or off state. That is, the control circuit 100 outputs the higher print data SIH included in the print data signal SI in the ejection control signal DATA and the constant change signal CH at the L level that controls the transfer gate 234 so as not to be switched in the period Ta. In other words, the control circuit 100 outputs the higher print data SIH included in the print data signal SI in which the logic level of the ejection control signal DATA changes without changing the logic level of the change signal CH in the period Ta.

In addition, as described above, the drive signal output circuit 51 outputs the trapezoidal waveform Adp included in the drive signal COM in the period Ta. In other words, at least a portion of the trapezoidal waveform Adp included in the drive signal COM output by the drive signal output circuit 51 is disposed in the period Ta.

In the period between the time t2 and the time t3 after the period Ta, the control circuit 100 stops the output of the clock signal SCK and also stops the output of the ejection control signal DATA. In this case, the control circuit 100 changes the logic level of the change signal CH from the L level to the H level. Therefore, the transfer gate 234 is switched to an on or off state according to the latch data [LTa, LTb] corresponding to the print data [SIH, SIL] input to the decoder 226. That is, the control circuit 100 outputs a change signal CH having an H level different from the L level that controls the transfer gate 234 to be switched in the period between the time t2 and the time t3 after the period Ta. In other words, the control circuit 100 changes the logic level of the change signal CH and does not change the logic level of the ejection control signal DATA in the period between the time t2 and the time t3 after the period Ta.

In the period Tb between the time t3 at which the change signal CH falls and the time t4 at which the change signal CH rises, the control circuit 100 serially outputs the lower print data SIL included in the print data signal SI in the ejection control signal DATA in synchronization with the clock signal SCK. Therefore, in the period Tb between the time t3 and the time t4, the lower print data SIL included in the print data signal SI in the ejection control signal DATA is input to the drive signal selection circuit 200. In this case, the control circuit 100 continues to output the change signal CH having L level. Therefore, the transfer gate 234 continues to be an on or off state. That is, the control circuit 100 outputs the lower print data SIL included in the print data signal SI in the ejection control signal DATA and the constant change signal CH at the L level that controls the transfer gate 234 so as not to be switched in the period Tb. In other words, the control circuit 100 outputs the lower print data SIL included in the print data signal SI in which the logic level of the ejection control signal DATA changes without changing the logic level of the change signal CH in the period Tb.

In addition, as described above, the drive signal output circuit 51 outputs the trapezoidal waveform Bdp included in the drive signal COM in the period Tb. In other words, at least a portion of the trapezoidal waveform Bdp included in the drive signal COM output by the drive signal output circuit 51 is disposed in the period Tb.

In the period between the time t4 and the time t5 after the period Tb, the control circuit 100 stops the output of the clock signal SCK and also stops the output of the ejection control signal DATA. In this case, the control circuit 100 changes the logic level of the change signal CH from the L level to the H level. Therefore, the transfer gate 234 is switched to an on or off state according to the latch data [LTa, LTb] corresponding to the print data [SIH, SIL] input to the decoder 226. That is, the control circuit 100 outputs a change signal CH having an H level different from the L level that controls the transfer gate 234 to be switched in the period between the time t4 and the time t5 after the period Tb. In other words, the control circuit 100 changes the logic level of the change signal CH and does not change the logic level of the ejection control signal DATA in the period between the time t4 and the time t5 after the period Tb.

In the period Tc between the time t5 at which the change signal CH falls and the time t6 at which the latch signal LAT rises, the control circuit 100 serially outputs the program data q0 to q3 included in the setting data signal SP in the ejection control signal DATA in synchronization with the clock signal SCK. Therefore, in the period Tc between the time t5 and the time t6, the program data q0 to q3 included in the setting data signal SP in the ejection control signal DATA are input to the drive signal selection circuit 200. In this case, the control circuit 100 continues to output the change signal CH having L level. Therefore, the transfer gate 234 continues to be an on or off state. That is, the control circuit 100 outputs the program data q0 to q3 included in the setting data signal SP in the ejection control signal DATA and the constant change signal CH at the L level that controls the transfer gate 234 so as not to be switched in the period Tc. In other words, the control circuit 100 outputs the program data q0 to q3 included in the setting data signal SP in which the logic level of the ejection control signal DATA changes without changing the logic level of the change signal CH in the period Tc.

In addition, as described above, the drive signal output circuit 51 outputs the trapezoidal waveform Cdp included in the drive signal COM in the period Tc. In other words, at least a portion of the trapezoidal waveform Cdp included in the drive signal COM output by the drive signal output circuit 51 is disposed in the period Tc.

When the latch signal LAT rises at time t6, the selection control signal generation group 262 latches the program data q0 to q3 held in the SP shift register group 261, generates the selection control signals Q0 to Q3 according to the latched program data q0 to q3, and outputs the selection control signals Q0 to Q3 to the decoder 226. In addition, when the latch signal LAT rises at time t6, each of the first latch circuits 224*a* latches the higher print data SIH held in the first shift register 222*a* all at once, and outputs the latched higher print data SIH as latch data LTa to the decoder 226. Each of the second latch circuits 224*b* latches the lower print data SIL held in the second shift register 222*b* all at once, and outputs the latched lower print data SIL as latch data LTb to the decoder 226.

The decoder 226 outputs a TG control signal S of the logic level defined by the selection control signals Q0 to Q3 according to the size of the dots defined by the latch data [LTa, LTb] corresponding to the print data [SIH, SIL].

Specifically, the decoder 226 selects the selection control signal Q0 when the print data [SIH, SIL] is [1, 1]. Therefore, the decoder 226 outputs the TG control signals S having the H, H, and L level in the periods Ta, Tb, and Tc. In this case, the selection circuit 230 selects the trapezoidal waveform Adp in the period Ta, selects the trapezoidal waveform Bdp in the period Tb, and does not select the trapezoidal waveform Cdp in the period Tc. As a result, the drive signal selection circuit 200 generates and outputs a drive signal VOUT corresponding to the "large dot" illustrated in FIG. 6.

In addition, the decoder 226 selects the selection control signal Q1 when the print data [SIH, SIL] is [1, 0]. Therefore, the decoder 226 outputs the TG control signals S having the H, L, and L level in the periods Ta, Tb, and Tc. In this case, the selection circuit 230 selects the trapezoidal waveform Adp in the period Ta, does not select the trapezoidal waveform Bdp in the period Tb, and does not select the trapezoidal waveform Cdp in the period Tc. As a result, the drive signal selection circuit 200 generates and outputs a drive signal VOUT corresponding to the "medium dot" illustrated in FIG. 6.

In addition, the decoder 226 selects the selection control signal Q2 when the print data [SIH, SIL] is [0, 1]. Therefore, the decoder 226 outputs the TG control signals S having the L, H, and L level in the periods Ta, Tb, and Tc. In this case, the selection circuit 230 does not select the trapezoidal waveform Adp in the period Ta, selects the trapezoidal waveform Bdp in the period Tb, and does not select the trapezoidal waveform Cdp in the period Tc. As a result, the drive signal selection circuit 200 generates and outputs a drive signal VOUT corresponding to the "small dot" illustrated in FIG. 6.

In addition, the decoder 226 selects the selection control signal Q3 when the print data [SIH, SIL] is [0, 0]. Therefore, the decoder 226 outputs the TG control signals S having the L, L, and H level in the periods Ta, Tb, and Tc. In this case, the selection circuit 230 does not select the trapezoidal waveform Adp in the period Ta, does not select the trapezoidal waveform Bdp in the period Tb, and selects the trapezoidal waveform Cdp in the period Tc. As a result, the drive signal selection circuit 200 generates and outputs a drive signal VOUT corresponding to the "non-recording" illustrated in FIG. 6.

Here, among the ejection control signal DATA output by the control circuit 100 included in the control mechanism 10, the higher print data SIH included in the print data signal SI in the ejection control signal DATA for controlling the drive of piezoelectric element 60, which is output by the control circuit 100 in the period Ta, is an example of a first information block. Among the ejection control signal DATA output by the control circuit 100 included in the control mechanism 10, the lower print data SIL included in the print data signal SI in the ejection control signal DATA for controlling the drive of piezoelectric element 60, which is output by the control circuit 100 in the period Tb, is an example of a third information block. Among the ejection control signal DATA output by the control circuit 100 included in the control mechanism 10, the program data q0 to q3 included in the setting data signal SP in the ejection control signal DATA for defining the drive pattern of the piezoelectric element 60, which is output by the control circuit 100 in the period Tb, is an example of a second information block. That is, the ejection control signal DATA includes a block that propagates the higher print data SIH included in the print data signal SI, a block that propagates the lower print data SIL included in the print data signal SI, and a block that propagates the program data q0 to q3 included in the setting data signal SP.

An example of the first period is the period Ta at which the control circuit 100 outputs the higher print data SIH included in the print data signal SI in the ejection control signal DATA and the constant change signal CH at the L level that controls the transfer gate 234 so as not to be switched. An example of the second period is a period after the period Ta and a period between the time t2 and the time t3 at which the control circuit 100 outputs the change signal CH in which the logic level for controlling the transfer gate 234 to be switched changes from the L level to the H level. An example of the third period is a period after a period between the time t2 and the time t3 and the period Tc at which the control circuit 100 outputs the lower print data SIL included in the print data signal SI in the ejection control signal DATA and the constant change signal CH at the L level that controls the transfer gate 234 so as not to be switched. An example of the fourth period is a period between the period between the time t2 and the time t3 and the period Tc, and the period Tb at which the control circuit 100 outputs the lower print data SIL included in the print data signal SI in the ejection control signal DATA and the constant change signal CH at the L level that controls the transfer gate 234 so as not to be switched. An example of the fifth period is a period between the period Tb and the period Tc, and a period between the time t4 and the time t5 at which the control circuit 100 outputs the change signal CH in which the logic level for controlling the transfer gate 234 to be switched changes from the L level to the H level.

6. Action Effect

In the printing apparatus 1 and the control mechanism 10 configured as described above, the ejection control signal DATA is transmitted separately in a block including the higher print data SIH, a block including the lower print data SIL, and a block including the program data q0 to q3. The control mechanism 10 outputs a block including the higher print data SIH in the ejection control signal DATA and a change signal CH having the L level for controlling the transfer gate 234 so as not to be switched in the period Ta. The control mechanism 10 outputs a change signal CH in which the logic level for controlling the transfer gate 234 to be switched changes from the L level to the H level in the period between the time t2 and the time t3 after the period Ta. The control mechanism 10 outputs a block including the higher print data SIH in the ejection control signal DATA and a change signal CH having the L level for controlling the transfer gate 234 so as not to be switched in the period Tc after the period between time t2 and time t3. That is, the control mechanism 10 outputs the ejection control signal DATA at the timing when the transfer gate 234 does not switch, and stops the output of the ejection control signal DATA at the timing when the transfer gate 234 switches. As a result, the possibility is reduced that the noise component generated when the transfer gate 234 is switched from on to off is superimposed on the ejection control signal DATA. Therefore, the possibility is reduced that the malfunction of the printing apparatus 1 is generated.

Furthermore, since the print head 21 includes the 1500 or more ejection portions 600, when the print head 21 includes 1500 or more transfer gates 234 corresponding to the ejection portions 600, a large current is generated when the transfer gate 234 is switched, and therefore, there is a possibility that the noise component generated when the transfer gate 234 is switched from on to off may increase. Even in such a case, the printing apparatus 1 and the control mechanism 10 in the present embodiment output the ejection control signal DATA at the timing when the transfer gate 234 does not switch, and stop the output of the ejection control signal DATA at the timing when the transfer gate 234 switches. Therefore, it is possible to reduce the possibility that the noise component generated when the transfer gate 234 is switched from on to off is superimposed on the ejection control signal DATA. Therefore, the possibility is reduced that malfunction of the printing apparatus 1 is generated.

In addition, in the printing apparatus 1 and the control mechanism 10 in the present embodiment, the block including the higher print data SIH in the ejection control signal DATA is output in the drive signal COM in the period Ta at which the trapezoidal waveform Adp for ejecting ink from the nozzle 651 is arranged. The block including the lower print data SIL in the ejection control signal DATA is output in the drive signal COM in the period Tb at which the trapezoidal waveform Bdp for ejecting ink from the nozzle 651 is arranged. The block including the program data q0 to q3 in the ejection control signal DATA is output in the drive signal COM in the period Tc at which the trapezoidal waveform Cdp vibrating slightly without ejecting ink from the nozzle 651 is arranged.

Among the trapezoidal waveforms Adp, Bdp, and Cdp included in the drive signal COM, the trapezoidal waveform Cdp that does not eject ink has a smaller maximum voltage value than that of the trapezoidal waveforms Adp, Bdp because the trapezoidal waveform Cdp does not eject ink. Therefore, the time during which the trapezoidal waveform Cdp is output in the drive signal COM is shorter than the time during which the trapezoidal waveforms Adp and Bdp are output. In addition, the amount of data included in the higher print data SIH and the lower print data SIL in the ejection control signal DATA increases as the number of nozzles 651 and piezoelectric element 60 of the print head 21 increases, whereas the program data q0 to q3 in the ejection control signal DATA are constant while increasing as the number of nozzles 651 and piezoelectric element 60 of the print head 21 increases, and furthermore, are smaller than the amount of data included in the higher print data SIH and the lower print data SIL in the ejection control signal DATA. Therefore, the time required to propagate the program data q0 to q3 in the ejection control signal DATA is shorter than the time required to propagate the higher print data SIH and the lower print data SIL in the ejection control signal DATA. At the timing when the trapezoidal waveform Cdp is output, which is shorter than the time when the trapezoidal waveforms Adp and Bdp are output in the drive signal COM, in the ejection control signal DATA, the program data q0 to q3 are propagated, which is shorter than the propagation time of the higher print data SIH and the lower print data SIL. Therefore, the possibility is reduced that the cycle T for ejecting ink on the medium P is inadvertently lengthened. That is, the time required to form an image on the medium P can be shortened, and the productivity of the printing apparatus 1 can be increased.

7. Modification Example

In the printing apparatus 1 and the control mechanism 10 in the above-described embodiment, it is described that the control circuit 100 included in the control mechanism 10 outputs the higher print data SIH in the ejection control signal DATA in the period Ta, outputs the lower print data SIL in the ejection control signal DATA in the period Tb, and outputs the program data q0 to q3 in the ejection control signal DATA in the period Tc. The higher print data SIH in the ejection control signal DATA and at least a portion of the lower print data SIL in the ejection control signal DATA may be output in the period Ta, a portion of the remaining part of the lower print data SIL in the ejection control signal DATA may be output in the period Tb, and the program data q0 to q3 in the ejection control signal DATA may be output in the period Tc. The higher print data SIH in the ejection control signal DATA and the lower print data SIL in the ejection control signal DATA may be output in the period Ta, the ejection control signal DATA may not be output in the period Tb, and the program data q0 to q3 in the ejection control signal DATA may be output in the period Tc. That is, the output of the ejection control signal DATA may be stopped at the timing when the control circuit 100 included in the control mechanism 10 outputs the change signal CH for switching the transfer gate 234. Even in such a case, the same action effects as those of the above-described embodiment can be exhibited.

Hereinbefore, although the embodiments and modification examples have been described, the present disclosure is not limited to these embodiments, and can be implemented in a range of various embodiments without departing from the gist thereof. For example, the above embodiments can be combined as appropriate.

The present disclosure includes a configuration substantially the same as the configuration described in the embodiment (for example, configuration having the same function, method and result, or configuration having the same object and effect). In addition, the present disclosure also includes a configuration in which a non-essential part of the configuration described in the embodiment is replaced. In addition, the present disclosure also includes a configuration that exhibits the same action effects as the configuration described in the embodiment or a configuration that can achieve the same object. In addition, the present disclosure also includes a configuration in which a known technique is added to the configuration described in the embodiment.

The following contents are derived from the above-described embodiments and modification examples.

According to an aspect of the present disclosure, there is provided a print head drive circuit that drives a print head including 1500 or more ejection modules each having an ejection portion having a piezoelectric element driven by supplying a drive signal and ejecting a liquid on a medium as the piezoelectric element is driven, and a changeover switch switching whether or not to supply the drive signal to the piezoelectric element, with a selection signal including a first information block and a second information block for selecting whether or not to drive the piezoelectric element, and a switching timing signal for changing a logic level to control a switching timing of the changeover switch, in which the print head drive circuit outputs the first information block in which a logic level of the selection signal changes without changing a logic level of the switching timing signal in a first period, changes the logic level of the switching timing signal, and does not change the logic level of the selection signal in a second period after the first period, and outputs the second information block in which the logic level of the selection signal changes without changing the logic level of the switching timing signal in a third period after the second period.

The print head drive circuit divides the selection signal for controlling the drive of 1500 or more piezoelectric elements into the first information block and the second information block, outputs the first information block in the selection signal and the switching timing signal in which the logic level that controls so that the changeover switch is not switched does not change in the first period, outputs a switching timing signal in which the logic level that controls so that the changeover switch is switched changes in the second period after the first period, and outputs the second information block in the selection signal and the switching timing signal in which the logic level does not change in the third period after the second period. That is, the changeover switch is not switched at the timing when the selection signal for controlling the drive of 1500 or more piezoelectric elements is output, and the changeover switch is switched at the timing when the selection signal for controlling the drive of 1500 or more piezoelectric elements is not output. As a result, the possibility is reduced that noise generated by switching the changeover switch is superimposed on the selection signal for controlling the drive of 1500 or more piezoelectric elements.

In the print head drive circuit, the selection signal may include a third information block, the print head drive circuit may output the third information block in which the logic level of the selection signal changes without changing the logic level of the switching timing signal in a fourth period between the second period and the third period, and may change the logic level of the switching timing signal, and may not change the logic level of the selection signal in a fifth period between the fourth period and the third period.

According to the print head drive circuit, the selection signals for controlling the drive of 1500 or more of the piezoelectric elements are divided into the first information block, the second information block, and the third information block, the third information block in the selection signal and the switching timing signal in which the logic level does not change are output in the fourth period between the second period and the third period, and the switching timing signal in which the logic level changes is output in the fifth period between the fourth period and the third period. That is, the changeover switch is not switched at the timing when the selection signal for controlling the drive of 1500 or more piezoelectric elements is output, and the changeover switch is switched at the timing when the selection signal for controlling the drive of 1500 or more piezoelectric elements is not output. As a result, the possibility is reduced that noise generated by switching the changeover switch is superimposed on the selection signal for controlling the drive of 1500 or more piezoelectric elements.

Furthermore, according to the print head drive circuit, it is possible to provide a plurality of timings at which the changeover switch is switched, and it is possible to control the waveform of the drive signal for ejecting ink from the print head in more detail. Therefore, it is possible to further improve the ink ejection accuracy.

In the print head drive circuit, the print head drive circuit may output a clock signal that defines a propagation timing of the selection signal, and may stop an output of the clock signal in the second period.

In the print head drive circuit, a control signal output circuit that outputs the selection signal and the switching timing signal may be provided.

In the print head drive circuit, the drive signal may include a first drive waveform that drives the piezoelectric element so as to eject the liquid from the ejection portion, and a second drive waveform that drives the piezoelectric element so that the liquid is not ejected from the ejection portion, and at least a portion of the first drive waveform may be arranged in the first period, and the second drive waveform may be arranged after the first drive waveform.

In the print head drive circuit, the first information block may include drive data for controlling a drive of the piezoelectric element, the second information block may include drive pattern data that defines a drive pattern of the piezoelectric element, and at least a portion of the second drive waveform may be arranged in the third period.

The maximum voltage value of the second drive waveform that drives the piezoelectric element so that the liquid is not ejected from the ejection portion is smaller than that of the first drive waveform that drives the piezoelectric element so as to eject the liquid from the ejection portion. Therefore, the cycle of the first drive waveform is shorter than the cycle of the second drive waveform. In addition, the drive data for controlling the drive of piezoelectric element included in the first information block is assigned to each ejection portion provided in the print head, whereas the drive pattern data that defines the drive pattern of the piezoelectric element included in the second information block is commonly assigned to each ejection portion provided in the print head. Therefore, a data length of the second information block including the drive pattern data defining the drive pattern of the piezoelectric element is shorter than a data length of the first information block including the drive data for controlling the drive of piezoelectric element.

According to the print head drive circuit, by setting the timing of outputting the second information block including the drive pattern data having a short data length as the timing of outputting the second drive waveform having a short waveform cycle, it is possible to reduce the difference between the period during which the drive signal is output to the print head and the period during which the selection signal is output to the print head. As a result, the ink ejection frequency can be improved. That is, it is possible to further increase the productivity of the printing apparatus provided with the print head drive circuit.

In the print head drive circuit, a drive signal output circuit that outputs the drive signal may be provided.

According to another aspect of the present disclosure, there is provided a printing apparatus including a print head including 1500 or more ejection modules each having an ejection portion having a piezoelectric element driven by supplying a drive signal and ejecting a liquid on a medium as the piezoelectric element is driven, and a changeover switch switching whether or not to supply the drive signal to the piezoelectric element; and a print head drive circuit that outputs a selection signal including a first information block and a second information block for selecting whether or not to drive the piezoelectric element driving the print head, and a switching timing signal for changing a logic level to control a switching timing of the changeover switch, in which the print head drive circuit outputs the first information block in which a logic level of the selection signal changes without changing a logic level of the switching timing signal in a first period, changes the logic level of the switching timing signal, and does not change the logic level of the selection signal in a second period after the first period, and outputs the second information block in which the logic level of the selection signal changes without changing the logic level of the switching timing signal in a third period after the second period.

According to the printing apparatus, the print head drive circuit divides the selection signal for controlling the drive of 1500 or more piezoelectric elements into the first information block and the second information block, outputs the first information block in the selection signal and the switching timing signal in which the logic level that controls so that the changeover switch is not switched does not change in the first period, outputs a switching timing signal in which the logic level that controls so that the changeover switch is switched changes in the second period after the first period, and outputs the second information block in the selection signal and the switching timing signal in which the logic level does not change in the third period after the second period. That is, in the print head drive circuit, the changeover switch is not switched at the timing when the selection signal for controlling the drive of 1500 or more piezoelectric elements is output, and the changeover switch is switched at the timing when the selection signal for controlling the drive of 1500 or more piezoelectric elements is not output. As a result, the possibility is reduced that noise generated by switching the changeover switch is superimposed on the selection signal for controlling the drive of 1500 or more piezoelectric elements. Therefore, the possibility is reduced that malfunction of the printing apparatus is generated.

What is claimed is:

1. A print head drive circuit that drives a print head including 1500 or more ejection modules each having an ejection portion having a piezoelectric element driven by supplying a drive signal and ejecting a liquid on a medium as the piezoelectric element is driven, and a changeover switch switching whether or not to supply the drive signal to the piezoelectric element, with a selection signal including a first information block and a second information block for selecting whether or not to drive the piezoelectric element, and a switching timing signal for changing a logic level to control a switching timing of the changeover switch, wherein the first information block includes drive data for controlling a drive of the piezoelectric element, the second information block includes drive pattern data that defines a drive pattern of the piezoelectric element, and the print head drive circuit outputs a clock signal that defines a propagation timing of the selection signal, outputs an entirety of the first information block in which a logic level of the selection signal changes without outputting the second information block and without changing a logic level of the switching timing signal in a first period, stops the output of the clock signal and changes the logic level of the switching timing signal, and does not change the logic level of the selection signal in a second period after the first period, and outputs an entirety of the second information block in which the logic level of the selection signal changes without outputting the first information block and without changing the logic level of the switching timing signal in a third period after the second period.

2. The print head drive circuit according to claim 1, wherein the selection signal includes a third information block, and the print head drive circuit outputs the third information block in which the logic level of the selection signal changes without changing the logic level of the switching timing signal in a fourth period between the second period and the third period, and changes the logic level of the switching timing signal, and does not change the logic level of the selection signal in a fifth period between the fourth period and the third period.

3. The print head drive circuit according to claim 1, comprising:

a control signal output circuit that outputs the selection signal and the switching timing signal.

4. The print head drive circuit according to claim 1, wherein the drive signal includes a first drive waveform that drives the piezoelectric element so as to eject the liquid from the ejection portion, and a second drive waveform that drives the piezoelectric element so that the liquid is not ejected from the ejection portion, and at least a portion of the first drive waveform is arranged in the first period, and the second drive waveform is arranged after the first drive waveform.

5. The print head drive circuit according to claim 4, wherein at least a portion of the second drive waveform is arranged in the third period.

6. The print head drive circuit according to claim 1, comprising:

a drive signal output circuit that outputs the drive signal.

7. A printing apparatus comprising:

a print head that includes 1500 or more ejection modules each having an ejection portion having a piezoelectric element driven by supplying a drive signal and ejecting a liquid on a medium as the piezoelectric element is driven, and a changeover switch switching whether or not to supply the drive signal to the piezoelectric element; and a print head drive circuit that outputs a selection signal including a first information block and a second information block for selecting whether or not to drive the piezoelectric element driving the print head, and a switching timing signal for changing a logic level to control a switching timing of the changeover switch, wherein the first information block includes drive data for controlling a drive of the piezoelectric element, the second information block includes drive pattern data that defines a drive pattern of the piezoelectric element, and the print head drive circuit outputs a clock signal that defines a propagation timing of the selection signal, outputs an entirety of the first information block in which a logic level of the selection signal changes without outputting the second information block and without changing a logic level of the switching timing signal in a first period, stops the output of the clock signal and changes the logic level of the switching timing signal, and does not change the logic level of the selection signal in a second period after the first period, and outputs an entirety of the second information block in which the logic level of the selection signal changes without outputting the first information block and without changing the logic level of the switching timing signal in a third period after the second period.

* * * * *